US006779977B2

(12) United States Patent
Lagrange et al.

(10) Patent No.: US 6,779,977 B2
(45) Date of Patent: Aug. 24, 2004

(54) AIRFOIL SHAPE FOR A TURBINE BUCKET

(75) Inventors: Benjamin Arnette Lagrange, Simpsonville, SC (US); Edward Lee McGrath, Easley, SC (US); James Bernard Fehlberg, Simpsonville, SC (US); Anthony Aaron Chiurato, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 84 days.

(21) Appl. No.: 10/320,655

(22) Filed: Dec. 17, 2002

(65) Prior Publication Data

US 2004/0115058 A1 Jun. 17, 2004

(51) Int. Cl.[7] ..... F01D 5/14
(52) U.S. Cl. ..... 416/223 A; 416/DIG. 2
(58) Field of Search ..... 416/223 A, 243, 416/DIG. 5, DIG. 2; 415/191, 211.2

(56) References Cited

U.S. PATENT DOCUMENTS 6,461,109 B1 10/2002 Wedlake et al.
6,461,110 B1 10/2002 By et al.
6,503,054 B1 1/2003 Bielek et al.
6,715,990 B1 * 4/2004 Arness et al. ..... 416/223 A
6,722,852 B1 * 4/2004 Wedlake et al. ..... 416/223 A

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

Second stage turbine buckets have airfoil profiles substantially in accordance with Cartesian coordinate values of X, Y and Z set forth Table I wherein X and Y values are in inches and the Z values are non-dimensional values from 0 to 1 convertible to Z distances in inches by multiplying the Z values by the height of the airfoil in inches. The X, Y and Z distances may be scalable as a function of the same constant or number to provide a scaled up or scaled down airfoil section for the bucket. The nominal airfoil given by the X, Y and Z distances lies within an envelop of ±0.160 inches in directions normal to the surface of the airfoil.

12 Claims, 3 Drawing Sheets

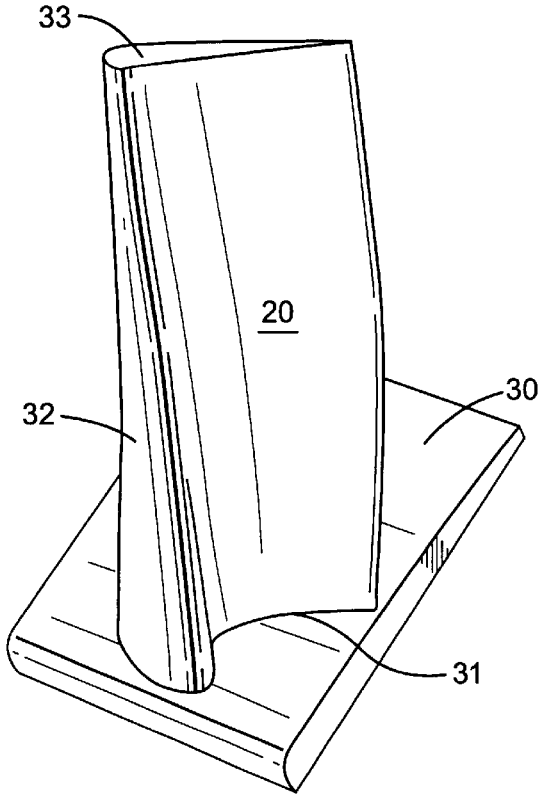
Fig. 2
Fig. 3
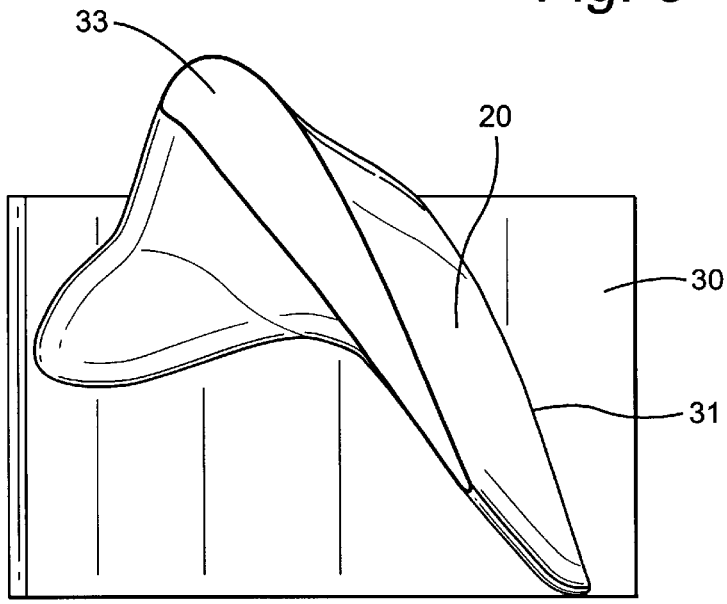

AIRFOIL SHAPE FOR A TURBINE BUCKET

BACKGROUND OF THE INVENTION

The present invention relates to an airfoil for a bucket of a stage of a gas turbine and particularly relates to a second stage turbine bucket airfoil profile.

Many system requirements must be met for each stage of the hot gas path section of a gas turbine in order to meet design goals including overall improved efficiency and airfoil loading. Particularly, the buckets of the second stage of the turbine section must meet the operating requirements for that particular stage and also be capable of efficient manufacture.

BRIEF DESCRIPTION OF THE INVENTION

In accordance with the preferred embodiment of the present invention there is provided a unique airfoil shape for a bucket of a gas turbine, preferably the second stage bucket, that enhances the performance of the gas turbine. The airfoil shape hereof improves the interaction between various stages of the turbine, affords improved aerodynamic efficiency and improved second stage airfoil aerodynamic and mechanical loading. The bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates of Table I which follows. The 3600 points for the coordinate values shown in Table I are relative to the turbine centerline and for a cold, i.e., room temperature profile at various cross-sections of the bucket airfoil along its length. The X and Y coordinates are given in distance dimensions, e.g., units of inches, and are joined smoothly at each Z location to form a smooth continuous airfoil cross-section. The Z coordinates are given in non-dimensionalized form from 0 to 1. By multiplying the airfoil height dimension, e.g., in inches, by the non-dimensional Z value of Table I, the airfoil shape, i.e., the profile, of the bucket is obtained. Each defined airfoil section in the X, Y plane is joined smoothly with adjacent airfoil sections in the Z direction to form the complete airfoil shape.

It will be appreciated that as each bucket airfoil heats up in use, the profile will change as a result of stress and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.160 inches from the nominal profile in a direction normal to any surface location along the nominal profile and which includes any coating process, defines a profile envelope for this bucket airfoil. The airfoil shape is robust to this variation without impairment of the mechanical and aerodynamic functions.

It will also be appreciated that the airfoil can be scaled up or scaled down geometrically for introduction into similar turbine designs. Consequently, the X and Y coordinates in inches and the non-dimensional Z coordinates, when converted to inches, of the nominal airfoil profile given below may be a function of the same constant or number. That is, the X, Y and Z coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape.

In a further preferred embodiment according to the present invention, there is provided a turbine bucket including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

In a further preferred embodiment according to the present invention, there is provided a turbine comprising a turbine wheel having a plurality of buckets, each of the buckets including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define the airfoil profile sections at each distance Z, the profile sections at the Z distances being joined smoothly with one another to form a complete airfoil shape.

In a further preferred embodiment according to the present invention, there is provided a turbine comprising a turbine wheel having a plurality of buckets, each of the buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down bucket airfoil.

BRIEF DESCRIPTION OF THE DRAWINGS

FIG. 2 is a perspective view of a bucket airfoil according to a preferred embodiment of the present invention with the airfoil illustrated on its platform;

FIG. 3 is a plan view of the airfoil shape as viewed from the airfoil tip;

DETAILED DESCRIPTION OF THE INVENTION

Figure 1:
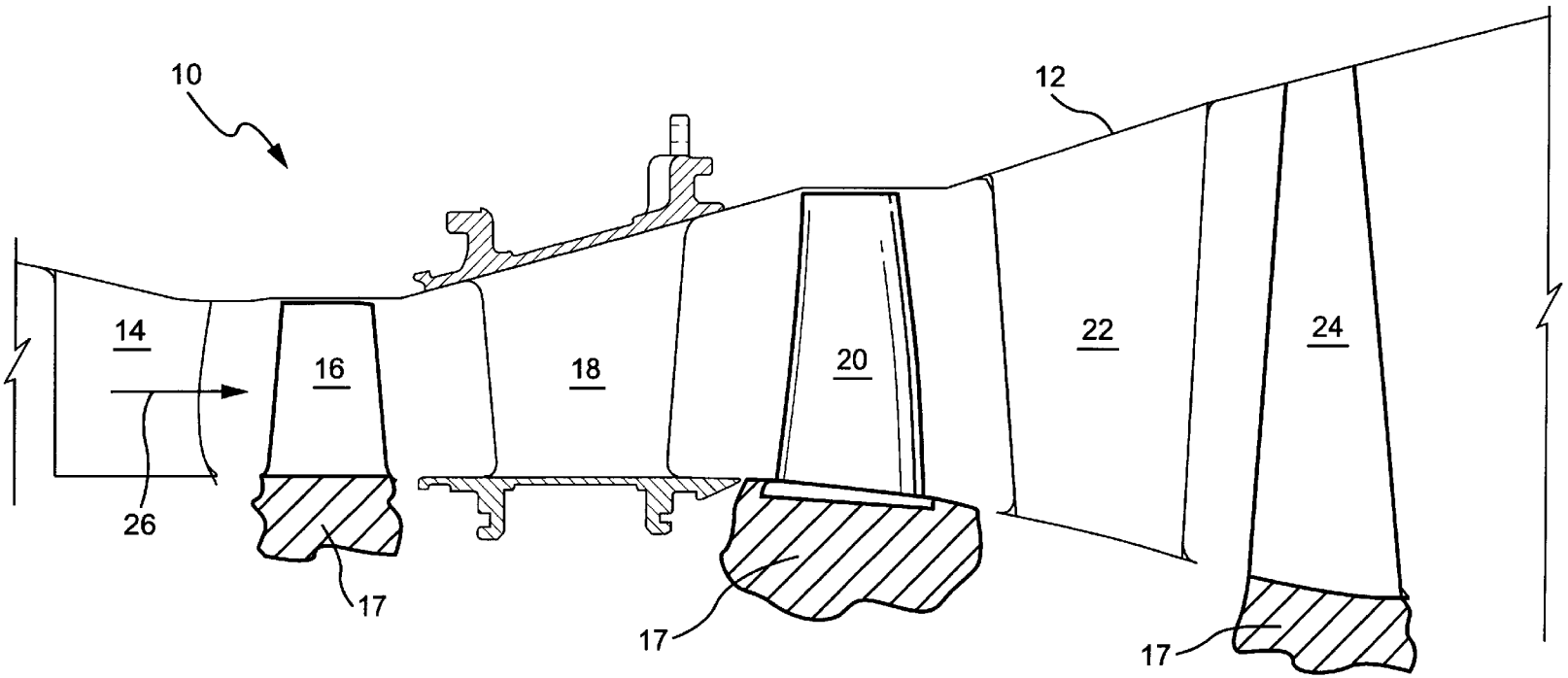
FIG. 1 is a schematic representation of a hot gas path through a gas turbine and illustrates a second stage bucket airfoil according to a preferred embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The buckets 16, of course, are mounted on the turbine rotor 17. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24. It will be appreciated that the nozzles and buckets lie in the hot gas path of the turbine, the hot gas path being indicated by the arrow 26.

Referring to FIG. 2, it will be appreciated that the buckets, for example, the buckets 20 of the second stage are mounted on a rotor wheel, not shown, forming part of rotor 17 and include platforms 30 at the roots 31 of the buckets. Typically, each bucket is provided with a dovetail section for connection with a mating dovetail section on the rotor wheel. It will also be appreciated that each bucket 20 is in the shape of an airfoil 32 as illustrated in FIGS. 2–6. That is, the buckets 20 each have a profile at any cross-section from the bucket root 31 to the bucket tip 33 in the shape of an airfoil 32. In this preferred embodiment, there are sixty (60) airfoils which constitute the buckets of the second stage of the turbine.

To define the airfoil shape of each second stage bucket, there is a unique set or loci of points in space that meet the stage requirements and can be manufactured. This unique loci of points meets the requirements for stage efficiency and are arrived at by iteration between aerodynamic and mechanical loadings enabling the turbine to run in an efficient, safe and smooth manner. The loci which defines the bucket profile comprises a set of 3600 points relative to the axis of rotation of the turbine. A Cartesian coordinate system of X, Y and Z values given in Table 1 below defines the profile of the airfoil at various locations along its length. The coordinate values for the X and Y coordinates are set forth in inches in Table I although other units of dimensions may be used when the values are appropriately converted. The Z values are set forth in Table I in non-dimensional form from 0 to 1. To convert the Z value to a Z coordinate value, e.g., in inches, the non-dimensional Z value given in the table is multiplied by the height of airfoil in inches. The airfoil height is measured from the root trailing edge, since the radial height of the flowpath extends across the second stage bucket. That is, the radial position of the root of the airfoil changes from the leading edge to the trailing edge. The disclosed points near the root follow the radial sloping of the flowpath as illustrated in FIG. 1 for defining the shape of the airfoil. The Cartesian coordinate system has orthogonally-related X, Y and Z axes and the X axis lies parallel to the turbine rotor centerline, i.e., the rotary axis.

By defining X and Y coordinate values at selected locations in a Z direction normal to the X, Y plane, the profile of the airfoil along its length in the Z direction can be ascertained. By connecting the X and Y values with smooth continuing arcs, each profile section at each distance Z is fixed. The surface profiles of the various surface locations between the distances Z are determined by smoothly connecting the adjacent profile sections to one another to form the airfoil. These values represent the airfoil profiles at ambient, non-operating or non-hot conditions and are for an uncoated airfoil. The sign convention assigns a positive value to Z values and positive and negative values for the X and Y coordinates as typically used in Cartesian coordinate systems.

The Table I values are generated and shown to three decimal places for determining the profile of the airfoil. There are typical manufacturing tolerances as well as coatings which must be accounted for in the actual profile of the airfoil. Accordingly, the values for the profile given in Table I are for a nominal airfoil. It will therefore be appreciated that ±typical manufacturing tolerances, i.e., ±values, including any coating thicknesses, are additive to the X and Y values given in Table I below. Accordingly, a distance of ±0.160 inches in a direction normal to any surface location along the airfoil profile defines an airfoil profile envelope for this particular bucket airfoil design and turbine.

The coordinate values given in Table I below provide the preferred nominal profile envelope.

TABLE I

| X | Y | Z' | X | Y | Z' | X | Y | Z' |
|---|---|---|---|---|---|---|---|---|
| 0.451 | −0.195 | 0.061 | 1.612 | 0.748 | 0.037 | 2.629 | −1.450 | 0.000 |
| 0.427 | 0.572 | 0.061 | 1.483 | −0.196 | 0.041 | 2.551 | −1.365 | 0.004 |
| 0.248 | 0.408 | 0.065 | 1.939 | 0.392 | 0.030 | 2.523 | −1.027 | 0.008 |
| 0.558 | 0.667 | 0.059 | 1.893 | 0.459 | 0.031 | 2.606 | −1.451 | 0.001 |
| 0.366 | 0.520 | 0.062 | 1.823 | −0.410 | 0.032 | 2.512 | −1.295 | 0.006 |
| 0.209 | −0.203 | 0.065 | 1.694 | −0.312 | 0.035 | 2.548 | −1.103 | 0.007 |
| 0.306 | 0.465 | 0.064 | 1.626 | −0.269 | 0.037 | 0.163 | 0.309 | 0.089 |
| 0.049 | 0.153 | 0.068 | 1.982 | 0.323 | 0.029 | 0.035 | 0.105 | 0.089 |
| 0.000 | 0.000 | 0.068 | 1.792 | 0.585 | 0.033 | 0.070 | 0.178 | 0.089 |
| 0.626 | 0.711 | 0.057 | 1.844 | 0.523 | 0.032 | 0.386 | 0.540 | 0.088 |
| 0.015 | 0.079 | 0.068 | 1.760 | −0.359 | 0.034 | 0.269 | 0.429 | 0.089 |
| 0.131 | −0.184 | 0.066 | 1.884 | −0.463 | 0.030 | 0.017 | 0.027 | 0.089 |
| 0.141 | 0.286 | 0.066 | 2.022 | 0.253 | 0.028 | 0.069 | −0.119 | 0.087 |
| 0.013 | −0.080 | 0.068 | 1.942 | −0.518 | 0.028 | 0.215 | 0.370 | 0.089 |
| 0.371 | −0.204 | 0.063 | 2.061 | 0.182 | 0.027 | 0.214 | −0.182 | 0.085 |
| 0.193 | 0.348 | 0.066 | 2.132 | 0.036 | 0.025 | 0.026 | −0.052 | 0.088 |
| 0.061 | −0.144 | 0.067 | 1.998 | −0.576 | 0.026 | 0.326 | 0.486 | 0.089 |
| 0.290 | −0.207 | 0.064 | 2.097 | 0.109 | 0.026 | 0.114 | 0.245 | 0.089 |
| 0.492 | 0.621 | 0.060 | 2.315 | −0.414 | 0.019 | 0.137 | −0.161 | 0.086 |
| 0.092 | 0.222 | 0.067 | 2.157 | −0.758 | 0.021 | 0.577 | 0.686 | 0.087 |
| 0.843 | 0.818 | 0.053 | 2.343 | −0.490 | 0.017 | 0.447 | 0.591 | 0.088 |
| 0.611 | −0.169 | 0.059 | 2.300 | −0.953 | 0.015 | 0.511 | 0.640 | 0.088 |
| 0.531 | −0.183 | 0.060 | 2.053 | −0.635 | 0.025 | 0.454 | −0.177 | 0.082 |
| 0.769 | 0.786 | 0.054 | 2.254 | −0.887 | 0.017 | 0.294 | −0.188 | 0.084 |
| 0.697 | 0.750 | 0.056 | 2.396 | −0.643 | 0.015 | 0.533 | −0.166 | 0.081 |
| 0.997 | 0.865 | 0.049 | 2.287 | −0.338 | 0.020 | 0.645 | 0.729 | 0.087 |
| 0.919 | 0.844 | 0.051 | 2.106 | −0.696 | 0.023 | 0.715 | 0.768 | 0.086 |
| 0.770 | −0.139 | 0.056 | 2.198 | −0.112 | 0.023 | 0.374 | −0.185 | 0.083 |
| 0.690 | −0.154 | 0.057 | 2.228 | −0.187 | 0.022 | 0.612 | −0.152 | 0.081 |
| 1.077 | 0.879 | 0.048 | 2.258 | −0.262 | 0.021 | 0.788 | 0.802 | 0.086 |
| 1.396 | 0.855 | 0.041 | 2.165 | −0.038 | 0.024 | 0.771 | −0.125 | 0.079 |
| 1.010 | −0.112 | 0.051 | 2.370 | −0.566 | 0.016 | 0.862 | 0.833 | 0.085 |
| 1.318 | 0.874 | 0.043 | 2.206 | −0.822 | 0.019 | 0.938 | 0.858 | 0.084 |
| 0.850 | −0.127 | 0.054 | 2.448 | −0.796 | 0.013 | 0.691 | −0.138 | 0.080 |
| 1.157 | 0.886 | 0.046 | 2.389 | −1.087 | 0.012 | 0.930 | −0.107 | 0.077 |
| 0.930 | −0.118 | 0.053 | 2.472 | −1.225 | 0.008 | 1.010 | −0.103 | 0.076 |
| 1.238 | 0.884 | 0.044 | 2.473 | −0.873 | 0.011 | 1.016 | 0.877 | 0.084 |
| 1.091 | −0.112 | 0.050 | 2.345 | −1.020 | 0.014 | 1.096 | 0.889 | 0.083 |
| 1.172 | −0.116 | 0.048 | 2.431 | −1.156 | 0.010 | 0.850 | −0.114 | 0.078 |
| 1.544 | 0.791 | 0.038 | 2.422 | −0.719 | 0.014 | 1.176 | 0.893 | 0.082 |
| 1.330 | −0.144 | 0.044 | 2.498 | −0.950 | 0.010 | 1.090 | −0.105 | 0.075 |
| 1.252 | −0.127 | 0.046 | 2.621 | −1.334 | 0.002 | 1.335 | 0.874 | 0.080 |
| 1.472 | 0.827 | 0.039 | 2.572 | −1.180 | 0.005 | 1.256 | 0.888 | 0.081 |
| 1.736 | 0.644 | 0.034 | 2.589 | −1.436 | 0.002 | 1.412 | 0.852 | 0.079 |
| 1.676 | 0.698 | 0.035 | 2.646 | −1.411 | 0.000 | 1.170 | −0.112 | 0.074 |
| 1.408 | −0.167 | 0.043 | 2.645 | −1.434 | 0.000 | 1.556 | 0.783 | 0.077 |
| 1.556 | −0.230 | 0.039 | 2.597 | −1.257 | 0.004 | 1.486 | 0.821 | 0.078 |
| 1.249 | −0.125 | 0.073 | 2.485 | −0.954 | 0.053 | 1.174 | −0.106 | 0.103 |
| 1.327 | −0.144 | 0.072 | 2.593 | −1.452 | 0.048 | 1.271 | 0.890 | 0.106 |

TABLE I-continued

| X | Y | Z' | X | Y | Z' | X | Y | Z' |
|---|---|---|---|---|---|---|---|---|
| 1.403 | −0.169 | 0.071 | 2.632 | −1.435 | 0.047 | 1.349 | 0.874 | 0.106 |
| 1.684 | 0.687 | 0.074 | 2.632 | −1.413 | 0.047 | 1.328 | −0.143 | 0.103 |
| 1.622 | 0.738 | 0.075 | 2.616 | −1.451 | 0.047 | 1.424 | 0.849 | 0.105 |
| 1.549 | −0.234 | 0.069 | 2.460 | −1.227 | 0.051 | 1.497 | 0.817 | 0.105 |
| 1.477 | −0.199 | 0.070 | 2.539 | −1.367 | 0.049 | 1.252 | −0.122 | 0.103 |
| 1.742 | 0.632 | 0.073 | 2.534 | −1.107 | 0.051 | 1.615 | −0.280 | 0.101 |
| 1.894 | 0.445 | 0.070 | 2.500 | −1.297 | 0.050 | 1.747 | 0.622 | 0.103 |
| 1.619 | −0.274 | 0.068 | 2.510 | −1.031 | 0.052 | 1.630 | 0.730 | 0.104 |
| 1.796 | 0.572 | 0.072 | 2.608 | −1.336 | 0.048 | 1.547 | −0.239 | 0.101 |
| 1.813 | −0.415 | 0.065 | 2.577 | −1.437 | 0.048 | 1.476 | −0.202 | 0.102 |
| 1.847 | 0.510 | 0.071 | 0.091 | 0.201 | 0.110 | 1.566 | 0.777 | 0.104 |
| 1.938 | 0.378 | 0.069 | 0.345 | 0.506 | 0.109 | 1.690 | 0.678 | 0.103 |
| 1.751 | −0.365 | 0.066 | 0.035 | 0.053 | 0.110 | 1.799 | 0.562 | 0.103 |
| 1.686 | −0.318 | 0.067 | 0.055 | 0.130 | 0.110 | 1.681 | −0.324 | 0.100 |
| 1.873 | −0.469 | 0.063 | 0.135 | 0.267 | 0.110 | 1.403 | −0.170 | 0.102 |
| 2.092 | 0.097 | 0.065 | 0.148 | −0.137 | 0.108 | 1.922 | −0.531 | 0.098 |
| 1.931 | −0.524 | 0.062 | 0.303 | −0.165 | 0.108 | 2.015 | 0.229 | 0.100 |
| 1.987 | −0.581 | 0.061 | 0.224 | −0.158 | 0.108 | 1.848 | 0.499 | 0.102 |
| 2.126 | 0.024 | 0.064 | 0.081 | −0.093 | 0.109 | 2.052 | 0.158 | 0.100 |
| 1.979 | 0.310 | 0.068 | 0.289 | 0.450 | 0.110 | 2.119 | 0.014 | 0.099 |
| 2.019 | 0.240 | 0.067 | 0.235 | 0.391 | 0.110 | 1.865 | −0.476 | 0.099 |
| 2.056 | 0.169 | 0.066 | 0.183 | 0.330 | 0.110 | 1.978 | −0.588 | 0.098 |
| 2.041 | −0.641 | 0.060 | 0.466 | 0.610 | 0.109 | 1.745 | −0.372 | 0.100 |
| 2.158 | −0.049 | 0.063 | 0.404 | 0.559 | 0.109 | 2.086 | 0.086 | 0.100 |
| 2.332 | −0.498 | 0.058 | 0.041 | −0.026 | 0.109 | 1.806 | −0.423 | 0.099 |
| 2.241 | −0.891 | 0.056 | 0.541 | −0.144 | 0.106 | 1.894 | 0.434 | 0.102 |
| 2.305 | −0.422 | 0.059 | 0.595 | 0.703 | 0.109 | 1.977 | 0.298 | 0.101 |
| 2.220 | −0.197 | 0.061 | 0.620 | −0.131 | 0.106 | 1.936 | 0.367 | 0.101 |
| 2.288 | −0.956 | 0.055 | 0.529 | 0.658 | 0.109 | 2.031 | −0.647 | 0.098 |
| 2.194 | −0.827 | 0.057 | 0.805 | 0.816 | 0.108 | 2.083 | −0.708 | 0.097 |
| 2.359 | −0.574 | 0.057 | 0.663 | 0.744 | 0.109 | 2.373 | −0.656 | 0.096 |
| 2.385 | −0.650 | 0.056 | 0.733 | 0.782 | 0.108 | 2.230 | −0.896 | 0.096 |
| 2.094 | −0.701 | 0.059 | 0.383 | −0.162 | 0.107 | 2.182 | −0.133 | 0.098 |
| 2.249 | −0.272 | 0.061 | 0.462 | −0.155 | 0.107 | 2.321 | −1.027 | 0.095 |
| 2.144 | −0.763 | 0.058 | 0.879 | 0.845 | 0.108 | 2.268 | −0.356 | 0.097 |
| 2.332 | −1.023 | 0.054 | 0.698 | −0.118 | 0.106 | 2.240 | −0.281 | 0.098 |
| 2.277 | −0.347 | 0.060 | 1.192 | 0.897 | 0.107 | 2.322 | −0.506 | 0.097 |
| 2.190 | −0.123 | 0.062 | 1.015 | −0.093 | 0.104 | 2.133 | −0.769 | 0.097 |
| 2.376 | −1.090 | 0.053 | 0.777 | −0.107 | 0.105 | 2.212 | −0.207 | 0.098 |
| 2.410 | −0.726 | 0.055 | 0.856 | −0.098 | 0.105 | 2.276 | −0.961 | 0.095 |
| 2.435 | −0.802 | 0.054 | 1.033 | 0.885 | 0.107 | 2.151 | −0.059 | 0.099 |
| 2.583 | −1.260 | 0.049 | 1.112 | 0.895 | 0.107 | 2.182 | −0.832 | 0.096 |
| 2.418 | −1.158 | 0.052 | 0.955 | 0.868 | 0.108 | 2.295 | −0.431 | 0.097 |
| 2.460 | −0.878 | 0.053 | 0.935 | −0.093 | 0.105 | 2.348 | −0.581 | 0.096 |
| 2.559 | −1.184 | 0.050 | 1.095 | −0.097 | 0.104 | 2.423 | −0.807 | 0.095 |
| 2.565 | −1.437 | 0.092 | 0.789 | −0.085 | 0.137 | 2.361 | −0.663 | 0.137 |
| 2.488 | −1.298 | 0.093 | 1.288 | 0.892 | 0.137 | 2.173 | −0.143 | 0.137 |
| 2.448 | −0.883 | 0.095 | 1.104 | −0.087 | 0.137 | 2.144 | −0.071 | 0.137 |
| 2.581 | −1.452 | 0.092 | 1.131 | 0.903 | 0.137 | 2.284 | −0.439 | 0.137 |
| 2.364 | −1.093 | 0.095 | 1.210 | 0.902 | 0.137 | 2.219 | −0.900 | 0.137 |
| 2.406 | −1.161 | 0.094 | 1.025 | −0.079 | 0.137 | 2.309 | −1.030 | 0.137 |
| 2.398 | −0.732 | 0.096 | 1.053 | 0.895 | 0.137 | 2.459 | −0.962 | 0.137 |
| 2.497 | −1.035 | 0.094 | 1.509 | 0.810 | 0.137 | 2.435 | −0.887 | 0.137 |
| 2.527 | −1.367 | 0.093 | 1.181 | −0.100 | 0.137 | 2.532 | −1.188 | 0.137 |
| 2.521 | −1.110 | 0.094 | 1.365 | 0.873 | 0.137 | 2.475 | −1.298 | 0.137 |
| 2.618 | −1.435 | 0.092 | 1.439 | 0.845 | 0.137 | 2.514 | −1.367 | 0.137 |
| 2.472 | −0.959 | 0.094 | 0.900 | 0.859 | 0.137 | 2.411 | −0.812 | 0.137 |
| 2.447 | −1.229 | 0.094 | 1.258 | −0.118 | 0.137 | 2.395 | −1.162 | 0.137 |
| 2.545 | −1.186 | 0.093 | 1.893 | 0.421 | 0.137 | 2.484 | −1.037 | 0.137 |
| 2.570 | −1.262 | 0.093 | 1.697 | 0.667 | 0.137 | 2.508 | −1.113 | 0.137 |
| 2.619 | −1.413 | 0.092 | 1.576 | 0.768 | 0.137 | 2.552 | −1.436 | 0.137 |
| 2.603 | −1.451 | 0.092 | 1.849 | 0.486 | 0.137 | 2.605 | −1.434 | 0.137 |
| 2.594 | −1.338 | 0.093 | 2.113 | 0.002 | 0.137 | 2.556 | −1.263 | 0.137 |
| 0.554 | −0.115 | 0.137 | 2.011 | 0.216 | 0.137 | 2.589 | −1.449 | 0.137 |
| 0.476 | −0.126 | 0.137 | 1.915 | −0.538 | 0.137 | 2.352 | −1.096 | 0.137 |
| 0.632 | −0.104 | 0.137 | 1.800 | −0.430 | 0.137 | 2.605 | −1.413 | 0.137 |
| 0.319 | −0.136 | 0.137 | 1.802 | 0.549 | 0.137 | 2.581 | −1.338 | 0.137 |
| 0.753 | 0.800 | 0.137 | 1.935 | 0.354 | 0.137 | 2.568 | −1.450 | 0.137 |
| 0.159 | 0.294 | 0.137 | 1.751 | 0.610 | 0.137 | 2.435 | −1.230 | 0.137 |
| 0.078 | 0.158 | 0.137 | 1.547 | −0.243 | 0.137 | 0.183 | −0.079 | 0.163 |
| 0.426 | 0.582 | 0.137 | 1.740 | −0.379 | 0.137 | 0.844 | 0.847 | 0.163 |
| 0.056 | 0.083 | 0.137 | 1.974 | 0.285 | 0.137 | 0.446 | 0.604 | 0.163 |
| 0.061 | 0.005 | 0.137 | 2.080 | 0.074 | 0.137 | 0.772 | 0.816 | 0.163 |
| 0.240 | −0.129 | 0.137 | 1.613 | −0.285 | 0.137 | 0.258 | −0.102 | 0.163 |
| 0.207 | 0.356 | 0.137 | 1.639 | 0.720 | 0.137 | 0.136 | 0.253 | 0.163 |
| 0.367 | 0.529 | 0.137 | 2.022 | −0.654 | 0.137 | 0.506 | 0.653 | 0.163 |
| 0.100 | −0.063 | 0.137 | 1.678 | −0.331 | 0.137 | 0.278 | 0.440 | 0.163 |

TABLE I-continued

| X | Y | Z' | X | Y | Z' | X | Y | Z' |
|---|---|---|---|---|---|---|---|---|
| 0.487 | 0.632 | 0.137 | 1.478 | −0.205 | 0.137 | 0.081 | 0.032 | 0.163 |
| 0.165 | −0.107 | 0.137 | 1.406 | −0.171 | 0.137 | 0.077 | 0.110 | 0.163 |
| 0.550 | 0.679 | 0.137 | 1.859 | −0.483 | 0.137 | 0.331 | 0.497 | 0.163 |
| 0.257 | 0.416 | 0.137 | 2.047 | 0.145 | 0.137 | 0.336 | −0.109 | 0.163 |
| 0.115 | 0.228 | 0.137 | 1.969 | −0.595 | 0.137 | 0.414 | −0.107 | 0.163 |
| 0.398 | −0.133 | 0.137 | 2.310 | −0.513 | 0.137 | 0.569 | 0.699 | 0.163 |
| 0.825 | 0.832 | 0.137 | 2.386 | −0.737 | 0.137 | 0.570 | −0.090 | 0.163 |
| 0.684 | 0.763 | 0.137 | 2.265 | −0.965 | 0.137 | 0.119 | −0.035 | 0.163 |
| 0.311 | 0.474 | 0.137 | 2.172 | −0.837 | 0.137 | 0.387 | 0.552 | 0.163 |
| 0.616 | 0.723 | 0.137 | 2.202 | −0.217 | 0.137 | 0.492 | −0.100 | 0.163 |
| 0.867 | −0.079 | 0.137 | 2.230 | −0.291 | 0.137 | 0.703 | 0.781 | 0.163 |
| 0.710 | −0.094 | 0.137 | 2.123 | −0.775 | 0.137 | 0.647 | −0.080 | 0.163 |
| 1.333 | −0.142 | 0.137 | 2.336 | −0.588 | 0.137 | 0.635 | 0.742 | 0.163 |
| 0.975 | 0.880 | 0.137 | 2.073 | −0.714 | 0.137 | 0.180 | 0.318 | 0.163 |
| 0.946 | −0.077 | 0.137 | 2.258 | −0.365 | 0.137 | 0.099 | 0.185 | 0.163 |
| 0.228 | 0.380 | 0.163 | 2.277 | −0.446 | 0.163 | 0.431 | −0.079 | 0.190 |
| 0.881 | −0.062 | 0.163 | 2.118 | −0.779 | 0.163 | 0.101 | 0.059 | 0.190 |
| 1.340 | −0.142 | 0.163 | 2.258 | −0.967 | 0.163 | 0.863 | 0.861 | 0.190 |
| 1.228 | 0.905 | 0.163 | 2.068 | −0.719 | 0.163 | 0.972 | −0.049 | 0.190 |
| 1.072 | 0.904 | 0.163 | 2.168 | −0.153 | 0.163 | 0.721 | 0.799 | 0.190 |
| 1.452 | 0.841 | 0.163 | 2.224 | −0.299 | 0.163 | 1.167 | 0.914 | 0.190 |
| 0.994 | 0.891 | 0.163 | 2.303 | −0.520 | 0.163 | 1.275 | −0.113 | 0.190 |
| 0.959 | −0.063 | 0.163 | 2.378 | −0.742 | 0.163 | 0.817 | −0.046 | 0.190 |
| 1.115 | −0.079 | 0.163 | 2.166 | −0.841 | 0.163 | 0.662 | −0.056 | 0.190 |
| 1.037 | −0.068 | 0.163 | 2.354 | −0.668 | 0.163 | 1.089 | 0.912 | 0.190 |
| 1.380 | 0.870 | 0.163 | 2.138 | −0.080 | 0.163 | 1.012 | 0.902 | 0.190 |
| 0.725 | −0.072 | 0.163 | 2.213 | −0.904 | 0.163 | 1.049 | −0.058 | 0.190 |
| 1.521 | 0.803 | 0.163 | 2.475 | −1.039 | 0.163 | 0.937 | 0.885 | 0.190 |
| 0.803 | −0.065 | 0.163 | 2.544 | −1.434 | 0.163 | 0.791 | 0.832 | 0.190 |
| 1.267 | −0.116 | 0.163 | 2.499 | −1.114 | 0.163 | 1.201 | −0.090 | 0.190 |
| 1.191 | −0.095 | 0.163 | 2.581 | −1.447 | 0.163 | 0.653 | 0.761 | 0.190 |
| 0.918 | 0.872 | 0.163 | 2.560 | −1.448 | 0.163 | 1.125 | −0.071 | 0.190 |
| 1.150 | 0.909 | 0.163 | 2.596 | −1.411 | 0.163 | 1.244 | 0.907 | 0.190 |
| 1.305 | 0.892 | 0.163 | 2.451 | −0.965 | 0.163 | 0.895 | −0.045 | 0.190 |
| 1.412 | −0.173 | 0.163 | 2.428 | −1.230 | 0.163 | 0.739 | −0.050 | 0.190 |
| 1.965 | −0.601 | 0.163 | 2.427 | −0.890 | 0.163 | 1.908 | −0.549 | 0.190 |
| 2.108 | −0.008 | 0.163 | 2.572 | −1.337 | 0.163 | 1.464 | 0.836 | 0.190 |
| 1.799 | −0.436 | 0.163 | 2.345 | −1.097 | 0.163 | 1.678 | −0.341 | 0.190 |
| 1.934 | 0.342 | 0.163 | 2.523 | −1.188 | 0.163 | 1.932 | 0.331 | 0.190 |
| 1.739 | −0.385 | 0.163 | 2.468 | −1.297 | 0.163 | 1.552 | −0.251 | 0.190 |
| 1.615 | −0.290 | 0.163 | 2.403 | −0.816 | 0.163 | 1.708 | 0.646 | 0.190 |
| 1.756 | 0.599 | 0.163 | 2.387 | −1.163 | 0.163 | 1.616 | −0.294 | 0.190 |
| 1.678 | −0.336 | 0.163 | 2.596 | −1.432 | 0.163 | 1.486 | −0.211 | 0.190 |
| 1.482 | −0.208 | 0.163 | 2.506 | −1.365 | 0.163 | 1.853 | −0.494 | 0.190 |
| 1.805 | 0.538 | 0.163 | 2.548 | −1.262 | 0.163 | 1.320 | 0.892 | 0.190 |
| 1.703 | 0.656 | 0.163 | 0.525 | 0.674 | 0.190 | 1.531 | 0.797 | 0.190 |
| 1.851 | 0.474 | 0.163 | 0.202 | −0.051 | 0.190 | 1.893 | 0.398 | 0.190 |
| 1.549 | −0.247 | 0.163 | 0.119 | 0.210 | 0.190 | 1.417 | −0.174 | 0.190 |
| 1.972 | 0.274 | 0.163 | 0.276 | −0.074 | 0.190 | 1.797 | −0.441 | 0.190 |
| 2.009 | 0.205 | 0.163 | 0.406 | 0.574 | 0.190 | 1.851 | 0.463 | 0.190 |
| 1.586 | 0.760 | 0.163 | 0.585 | −0.064 | 0.190 | 1.594 | 0.751 | 0.190 |
| 2.076 | 0.064 | 0.163 | 0.508 | −0.073 | 0.190 | 1.961 | −0.605 | 0.190 |
| 2.018 | −0.659 | 0.163 | 0.464 | 0.625 | 0.190 | 1.394 | 0.868 | 0.190 |
| 1.646 | 0.710 | 0.163 | 0.298 | 0.463 | 0.190 | 1.806 | 0.526 | 0.190 |
| 1.894 | 0.409 | 0.163 | 0.588 | 0.719 | 0.190 | 1.653 | 0.701 | 0.190 |
| 1.912 | −0.544 | 0.163 | 0.248 | 0.404 | 0.190 | 1.970 | 0.263 | 0.190 |
| 2.043 | 0.134 | 0.163 | 0.138 | −0.008 | 0.190 | 1.739 | −0.390 | 0.190 |
| 1.856 | −0.489 | 0.163 | 0.350 | 0.520 | 0.190 | 1.347 | −0.141 | 0.190 |
| 2.328 | −0.593 | 0.163 | 0.157 | 0.278 | 0.190 | 1.759 | 0.588 | 0.190 |
| 2.196 | −0.225 | 0.163 | 0.097 | 0.136 | 0.190 | 2.295 | −1.033 | 0.190 |
| 2.251 | −0.372 | 0.163 | 0.353 | −0.081 | 0.190 | 2.295 | −0.525 | 0.190 |
| 2.302 | −1.032 | 0.163 | 0.200 | 0.342 | 0.190 | 2.072 | 0.054 | 0.190 |
| 2.244 | −0.379 | 0.190 | 0.448 | −0.051 | 0.217 | 1.423 | −0.174 | 0.217 |
| 2.006 | 0.194 | 0.190 | 0.423 | 0.596 | 0.217 | 1.851 | −0.498 | 0.217 |
| 2.040 | 0.124 | 0.190 | 0.120 | 0.086 | 0.217 | 1.555 | −0.253 | 0.217 |
| 2.162 | −0.161 | 0.190 | 0.605 | 0.739 | 0.217 | 2.210 | −0.312 | 0.217 |
| 2.270 | −0.452 | 0.190 | 0.525 | −0.046 | 0.217 | 2.199 | −0.908 | 0.217 |
| 2.160 | −0.844 | 0.190 | 0.116 | 0.162 | 0.217 | 2.097 | −0.026 | 0.217 |
| 2.103 | −0.017 | 0.190 | 0.601 | −0.039 | 0.217 | 2.236 | −0.385 | 0.217 |
| 2.190 | −0.233 | 0.190 | 0.371 | −0.053 | 0.217 | 2.127 | −0.097 | 0.217 |
| 2.206 | −0.906 | 0.190 | 1.211 | −0.084 | 0.217 | 2.067 | 0.045 | 0.217 |
| 2.112 | −0.783 | 0.190 | 0.738 | 0.816 | 0.217 | 2.288 | −1.034 | 0.217 |
| 2.133 | −0.089 | 0.190 | 0.985 | −0.035 | 0.217 | 2.001 | 0.184 | 0.217 |
| 2.063 | −0.723 | 0.190 | 1.061 | −0.047 | 0.217 | 2.183 | −0.240 | 0.217 |
| 2.217 | −0.306 | 0.190 | 0.755 | −0.027 | 0.217 | 2.035 | 0.115 | 0.217 |
| 2.251 | −0.969 | 0.190 | 1.283 | −0.109 | 0.217 | 2.262 | −0.457 | 0.217 |
| 2.013 | −0.663 | 0.190 | 0.879 | 0.875 | 0.217 | 2.155 | −0.168 | 0.217 |

TABLE I-continued

| X | Y | Z' | X | Y | Z' | X | Y | Z' |
|---|---|---|---|---|---|---|---|---|
| 2.442 | −0.967 | 0.190 | 1.259 | 0.910 | 0.217 | 2.058 | −0.725 | 0.217 |
| 2.345 | −0.672 | 0.190 | 0.832 | −0.026 | 0.217 | 2.008 | −0.666 | 0.217 |
| 2.514 | −1.188 | 0.190 | 1.105 | 0.919 | 0.217 | 2.244 | −0.970 | 0.217 |
| 2.587 | −1.409 | 0.190 | 0.807 | 0.848 | 0.217 | 2.154 | −0.846 | 0.217 |
| 2.587 | −1.430 | 0.190 | 0.909 | −0.028 | 0.217 | 2.106 | −0.785 | 0.217 |
| 2.320 | −0.598 | 0.190 | 1.029 | 0.912 | 0.217 | 2.287 | −0.530 | 0.217 |
| 2.572 | −1.444 | 0.190 | 0.678 | −0.032 | 0.217 | 2.490 | −1.361 | 0.217 |
| 2.380 | −1.163 | 0.190 | 0.953 | 0.897 | 0.217 | 2.330 | −1.098 | 0.217 |
| 2.466 | −1.040 | 0.190 | 1.182 | 0.919 | 0.217 | 2.312 | −0.602 | 0.217 |
| 2.460 | −1.296 | 0.190 | 1.136 | −0.063 | 0.217 | 2.578 | −1.406 | 0.217 |
| 2.490 | −1.114 | 0.190 | 0.670 | 0.779 | 0.217 | 2.433 | −0.968 | 0.217 |
| 2.498 | −1.363 | 0.190 | 1.930 | 0.321 | 0.217 | 2.543 | −1.441 | 0.217 |
| 2.539 | −1.262 | 0.190 | 1.490 | −0.212 | 0.217 | 2.372 | −1.163 | 0.217 |
| 2.418 | −0.893 | 0.190 | 1.760 | 0.577 | 0.217 | 2.527 | −1.428 | 0.217 |
| 2.394 | −0.819 | 0.190 | 1.354 | −0.140 | 0.217 | 2.337 | −0.675 | 0.217 |
| 2.551 | −1.445 | 0.190 | 1.850 | 0.452 | 0.217 | 2.529 | −1.260 | 0.217 |
| 2.563 | −1.335 | 0.190 | 1.957 | −0.609 | 0.217 | 2.554 | −1.333 | 0.217 |
| 2.370 | −0.745 | 0.190 | 1.618 | −0.297 | 0.217 | 2.563 | −1.440 | 0.217 |
| 2.536 | −1.431 | 0.190 | 1.333 | 0.892 | 0.217 | 2.409 | −0.894 | 0.217 |
| 2.420 | −1.229 | 0.190 | 1.406 | 0.865 | 0.217 | 2.361 | −0.748 | 0.217 |
| 2.338 | −1.098 | 0.190 | 1.738 | −0.393 | 0.217 | 2.481 | −1.114 | 0.217 |
| 0.139 | 0.235 | 0.217 | 1.905 | −0.552 | 0.217 | 2.578 | −1.426 | 0.217 |
| 0.158 | 0.019 | 0.217 | 1.966 | 0.253 | 0.217 | 2.457 | −1.041 | 0.217 |
| 0.176 | 0.303 | 0.217 | 1.795 | −0.444 | 0.217 | 2.385 | −0.821 | 0.217 |
| 0.266 | 0.427 | 0.217 | 1.891 | 0.387 | 0.217 | 2.505 | −1.187 | 0.217 |
| 0.542 | 0.694 | 0.217 | 1.475 | 0.831 | 0.217 | 2.451 | −1.294 | 0.217 |
| 0.368 | 0.543 | 0.217 | 1.679 | −0.344 | 0.217 | 2.412 | −1.228 | 0.217 |
| 0.316 | 0.486 | 0.217 | 1.807 | 0.516 | 0.217 | 0.135 | 0.187 | 0.244 |
| 0.219 | 0.366 | 0.217 | 1.711 | 0.636 | 0.217 | 0.496 | 0.668 | 0.244 |
| 0.221 | −0.024 | 0.217 | 1.658 | 0.692 | 0.217 | 0.236 | 0.390 | 0.244 |
| 0.294 | −0.046 | 0.217 | 1.540 | 0.790 | 0.217 | 0.282 | 0.450 | 0.244 |
| 0.481 | 0.647 | 0.217 | 1.601 | 0.743 | 0.217 | 0.331 | 0.509 | 0.244 |
| 0.466 | −0.024 | 0.244 | 1.761 | 0.568 | 0.244 | 2.534 | −1.437 | 0.244 |
| 0.193 | 0.326 | 0.244 | 1.794 | −0.446 | 0.244 | 0.261 | 0.030 | 0.271 |
| 0.438 | 0.618 | 0.244 | 1.954 | −0.611 | 0.244 | 0.209 | 0.349 | 0.271 |
| 0.542 | −0.019 | 0.244 | 1.345 | 0.891 | 0.244 | 0.509 | 0.689 | 0.271 |
| 0.390 | −0.025 | 0.244 | 1.926 | 0.311 | 0.244 | 0.173 | 0.282 | 0.271 |
| 0.556 | 0.715 | 0.244 | 1.902 | −0.554 | 0.244 | 0.569 | 0.735 | 0.271 |
| 0.177 | 0.046 | 0.244 | 1.605 | 0.736 | 0.244 | 0.297 | 0.473 | 0.271 |
| 0.314 | −0.018 | 0.244 | 1.415 | 0.862 | 0.244 | 0.632 | 0.778 | 0.271 |
| 0.240 | 0.004 | 0.244 | 1.558 | −0.253 | 0.244 | 0.560 | 0.008 | 0.271 |
| 0.139 | 0.111 | 0.244 | 2.303 | −0.606 | 0.244 | 0.152 | 0.210 | 0.271 |
| 0.619 | 0.758 | 0.244 | 2.148 | −0.175 | 0.244 | 0.451 | 0.639 | 0.271 |
| 0.618 | −0.013 | 0.244 | 2.101 | −0.786 | 0.244 | 0.485 | 0.004 | 0.271 |
| 0.157 | 0.260 | 0.244 | 2.120 | −0.104 | 0.244 | 0.333 | 0.010 | 0.271 |
| 0.383 | 0.565 | 0.244 | 2.278 | −0.533 | 0.244 | 0.397 | 0.587 | 0.271 |
| 0.923 | −0.011 | 0.244 | 2.053 | −0.726 | 0.244 | 0.251 | 0.412 | 0.271 |
| 1.221 | −0.076 | 0.244 | 2.060 | 0.037 | 0.244 | 0.197 | 0.071 | 0.271 |
| 0.968 | 0.909 | 0.244 | 2.090 | −0.033 | 0.244 | 0.158 | 0.135 | 0.271 |
| 1.292 | −0.104 | 0.244 | 2.237 | −0.970 | 0.244 | 0.345 | 0.531 | 0.271 |
| 1.271 | 0.911 | 0.244 | 2.193 | −0.908 | 0.244 | 0.409 | 0.003 | 0.271 |
| 0.694 | −0.008 | 0.244 | 2.228 | −0.389 | 0.244 | 0.636 | 0.013 | 0.271 |
| 0.771 | −0.005 | 0.244 | 2.281 | −1.033 | 0.244 | 0.980 | 0.921 | 0.271 |
| 0.752 | 0.833 | 0.244 | 2.148 | −0.847 | 0.244 | 0.697 | 0.816 | 0.271 |
| 0.999 | −0.020 | 0.244 | 2.004 | −0.668 | 0.244 | 1.055 | 0.931 | 0.271 |
| 0.894 | 0.889 | 0.244 | 1.996 | 0.176 | 0.244 | 0.939 | 0.008 | 0.271 |
| 1.148 | −0.053 | 0.244 | 2.175 | −0.246 | 0.244 | 0.788 | 0.018 | 0.271 |
| 0.685 | 0.798 | 0.244 | 2.253 | −0.461 | 0.244 | 1.207 | 0.928 | 0.271 |
| 1.043 | 0.921 | 0.244 | 2.029 | 0.107 | 0.244 | 0.907 | 0.903 | 0.271 |
| 1.119 | 0.926 | 0.244 | 2.202 | −0.318 | 0.244 | 0.835 | 0.879 | 0.271 |
| 1.196 | 0.923 | 0.244 | 2.404 | −1.226 | 0.244 | 0.765 | 0.850 | 0.271 |
| 0.822 | 0.864 | 0.244 | 2.400 | −0.895 | 0.244 | 0.712 | 0.017 | 0.271 |
| 1.074 | −0.034 | 0.244 | 2.554 | −1.436 | 0.244 | 0.863 | 0.015 | 0.271 |
| 0.847 | −0.006 | 0.244 | 2.544 | −1.330 | 0.244 | 1.161 | −0.041 | 0.271 |
| 1.962 | 0.244 | 0.244 | 2.569 | −1.403 | 0.244 | 1.088 | −0.020 | 0.271 |
| 1.806 | 0.506 | 0.244 | 2.520 | −1.258 | 0.244 | 1.014 | −0.004 | 0.271 |
| 1.738 | −0.395 | 0.244 | 2.424 | −0.968 | 0.244 | 1.281 | 0.913 | 0.271 |
| 1.361 | −0.136 | 0.244 | 2.352 | −0.750 | 0.244 | 1.131 | 0.933 | 0.271 |
| 1.494 | −0.211 | 0.244 | 2.448 | −1.040 | 0.244 | 1.232 | −0.067 | 0.271 |
| 1.712 | 0.627 | 0.244 | 2.376 | −0.823 | 0.244 | 1.302 | −0.097 | 0.271 |
| 1.848 | 0.443 | 0.244 | 2.568 | −1.423 | 0.244 | 1.884 | 0.369 | 0.271 |
| 1.680 | −0.345 | 0.244 | 2.472 | −1.113 | 0.244 | 1.900 | −0.554 | 0.271 |
| 1.661 | 0.683 | 0.244 | 2.323 | −1.097 | 0.244 | 1.845 | 0.434 | 0.271 |
| 1.546 | 0.784 | 0.244 | 2.443 | −1.292 | 0.244 | 1.759 | 0.560 | 0.271 |
| 1.888 | 0.378 | 0.244 | 2.328 | −0.678 | 0.244 | 1.353 | 0.891 | 0.271 |
| 1.620 | −0.298 | 0.244 | 2.496 | −1.185 | 0.244 | 1.488 | 0.822 | 0.271 |
| 1.849 | −0.500 | 0.244 | 2.519 | −1.424 | 0.244 | 1.550 | 0.778 | 0.271 |

TABLE I-continued

| X | Y | Z' | X | Y | Z' | X | Y | Z' |
|---|---|---|---|---|---|---|---|---|
| 1.429 | −0.172 | 0.244 | 2.481 | −1.358 | 0.244 | 1.682 | −0.344 | 0.271 |
| 1.483 | 0.826 | 0.244 | 2.364 | −1.161 | 0.244 | 1.370 | −0.130 | 0.271 |
| 1.920 | 0.303 | 0.271 | 2.559 | −1.418 | 0.271 | 1.914 | 0.296 | 0.298 |
| 1.623 | −0.296 | 0.271 | 2.462 | −1.111 | 0.271 | 1.949 | −0.609 | 0.298 |
| 1.563 | −0.250 | 0.271 | 2.391 | −0.895 | 0.271 | 1.799 | 0.490 | 0.298 |
| 1.608 | 0.729 | 0.271 | 2.343 | −0.752 | 0.271 | 1.899 | −0.553 | 0.298 |
| 1.956 | 0.236 | 0.271 | 2.559 | −1.399 | 0.271 | 1.740 | −0.392 | 0.298 |
| 1.436 | −0.167 | 0.271 | 2.544 | −1.432 | 0.271 | 1.685 | −0.341 | 0.298 |
| 1.739 | −0.394 | 0.271 | 2.525 | −1.433 | 0.271 | 1.840 | 0.427 | 0.298 |
| 1.794 | −0.446 | 0.271 | 0.218 | 0.096 | 0.298 | 1.507 | −0.202 | 0.298 |
| 1.423 | 0.860 | 0.271 | 0.580 | 0.755 | 0.298 | 1.568 | −0.246 | 0.298 |
| 1.951 | −0.611 | 0.271 | 0.504 | 0.032 | 0.298 | 1.609 | 0.723 | 0.298 |
| 1.712 | 0.619 | 0.271 | 0.281 | 0.057 | 0.298 | 1.756 | 0.552 | 0.298 |
| 1.662 | 0.676 | 0.271 | 0.463 | 0.661 | 0.298 | 1.878 | 0.362 | 0.298 |
| 1.500 | −0.207 | 0.271 | 0.408 | 0.608 | 0.298 | 1.661 | 0.669 | 0.298 |
| 1.848 | −0.499 | 0.271 | 0.265 | 0.434 | 0.298 | 1.552 | 0.773 | 0.298 |
| 1.803 | 0.498 | 0.271 | 0.429 | 0.031 | 0.298 | 1.795 | −0.444 | 0.298 |
| 2.111 | −0.110 | 0.271 | 0.354 | 0.038 | 0.298 | 1.428 | 0.857 | 0.298 |
| 2.053 | 0.030 | 0.271 | 0.169 | 0.232 | 0.298 | 1.313 | −0.087 | 0.298 |
| 2.049 | −0.726 | 0.271 | 0.309 | 0.495 | 0.298 | 1.360 | 0.890 | 0.298 |
| 1.989 | 0.168 | 0.271 | 0.224 | 0.371 | 0.298 | 1.444 | −0.161 | 0.298 |
| 2.096 | −0.786 | 0.271 | 0.520 | 0.710 | 0.298 | 1.710 | 0.612 | 0.298 |
| 2.166 | −0.251 | 0.271 | 0.189 | 0.305 | 0.298 | 1.848 | −0.498 | 0.298 |
| 2.219 | −0.393 | 0.271 | 0.580 | 0.035 | 0.298 | 2.157 | −0.255 | 0.298 |
| 2.193 | −0.322 | 0.271 | 0.357 | 0.553 | 0.298 | 2.130 | −0.185 | 0.298 |
| 2.022 | 0.099 | 0.271 | 0.176 | 0.158 | 0.298 | 2.181 | −0.905 | 0.298 |
| 2.142 | −0.846 | 0.271 | 0.642 | 0.797 | 0.298 | 2.103 | −0.115 | 0.298 |
| 2.231 | −0.969 | 0.271 | 1.141 | 0.940 | 0.298 | 2.137 | −0.844 | 0.298 |
| 2.083 | −0.039 | 0.271 | 1.244 | −0.056 | 0.298 | 1.982 | 0.161 | 0.298 |
| 2.000 | −0.668 | 0.271 | 1.289 | 0.915 | 0.298 | 2.183 | −0.326 | 0.298 |
| 2.187 | −0.907 | 0.271 | 1.174 | −0.028 | 0.298 | 2.044 | 0.024 | 0.298 |
| 2.244 | −0.465 | 0.271 | 0.707 | 0.835 | 0.298 | 2.259 | −0.538 | 0.298 |
| 2.139 | −0.180 | 0.271 | 0.805 | 0.041 | 0.298 | 2.074 | −0.045 | 0.298 |
| 2.396 | −1.223 | 0.271 | 0.845 | 0.895 | 0.298 | 2.092 | −0.784 | 0.298 |
| 2.510 | −1.420 | 0.271 | 1.216 | 0.932 | 0.298 | 2.045 | −0.725 | 0.298 |
| 2.510 | −1.255 | 0.271 | 0.775 | 0.868 | 0.298 | 2.014 | 0.093 | 0.298 |
| 2.435 | −1.288 | 0.271 | 0.991 | 0.932 | 0.298 | 1.998 | −0.666 | 0.298 |
| 2.486 | −1.183 | 0.271 | 0.881 | 0.036 | 0.298 | 2.234 | −0.467 | 0.298 |
| 2.534 | −1.327 | 0.271 | 0.655 | 0.039 | 0.298 | 2.209 | −0.396 | 0.298 |
| 2.315 | −1.095 | 0.271 | 1.029 | 0.013 | 0.298 | 2.224 | −0.967 | 0.298 |
| 2.473 | −1.354 | 0.271 | 0.955 | 0.027 | 0.298 | 2.549 | −1.394 | 0.298 |
| 2.318 | −0.680 | 0.271 | 0.917 | 0.917 | 0.298 | 2.428 | −1.038 | 0.298 |
| 2.273 | −1.032 | 0.271 | 0.730 | 0.041 | 0.298 | 2.308 | −1.092 | 0.298 |
| 2.414 | −0.967 | 0.271 | 1.066 | 0.940 | 0.298 | 2.388 | −1.220 | 0.298 |
| 2.367 | −0.823 | 0.271 | 1.102 | −0.005 | 0.298 | 2.549 | −1.414 | 0.298 |
| 2.269 | −0.536 | 0.271 | 1.492 | 0.818 | 0.298 | 2.357 | −0.823 | 0.298 |
| 2.356 | −1.159 | 0.271 | 1.379 | −0.122 | 0.298 | 2.500 | −1.252 | 0.298 |
| 2.294 | −0.608 | 0.271 | 1.627 | −0.293 | 0.298 | 2.464 | −1.350 | 0.298 |
| 2.438 | −1.039 | 0.271 | 1.949 | 0.229 | 0.298 | 2.476 | −1.181 | 0.298 |
| 2.333 | −0.752 | 0.298 | 1.224 | 0.936 | 0.325 | 2.490 | −1.248 | 0.325 |
| 2.501 | −1.415 | 0.298 | 1.075 | 0.950 | 0.325 | 2.442 | −1.106 | 0.325 |
| 2.452 | −1.109 | 0.298 | 1.941 | 0.223 | 0.325 | 2.394 | −0.965 | 0.325 |
| 2.535 | −1.427 | 0.298 | 1.834 | 0.420 | 0.325 | 2.340 | −1.152 | 0.325 |
| 2.267 | −1.029 | 0.298 | 1.848 | −0.494 | 0.325 | 2.298 | −0.681 | 0.325 |
| 2.516 | −1.428 | 0.298 | 1.794 | 0.483 | 0.325 | 2.506 | −1.422 | 0.325 |
| 2.381 | −0.895 | 0.298 | 1.689 | −0.336 | 0.325 | 2.515 | −1.319 | 0.325 |
| 2.309 | −0.681 | 0.298 | 1.797 | −0.440 | 0.325 | 2.300 | −1.089 | 0.325 |
| 2.426 | −1.285 | 0.298 | 1.947 | −0.606 | 0.325 | 2.418 | −1.035 | 0.325 |
| 2.525 | −1.323 | 0.298 | 1.453 | −0.152 | 0.325 | 2.274 | −0.610 | 0.325 |
| 2.348 | −1.156 | 0.298 | 1.659 | 0.663 | 0.325 | 2.492 | −1.410 | 0.325 |
| 2.405 | −0.966 | 0.298 | 1.871 | 0.355 | 0.325 | 2.323 | −0.752 | 0.325 |
| 2.284 | −0.610 | 0.298 | 1.707 | 0.605 | 0.325 | 2.539 | −1.408 | 0.325 |
| 0.238 | 0.120 | 0.325 | 1.973 | 0.156 | 0.325 | 2.455 | −1.345 | 0.325 |
| 0.321 | 0.517 | 0.325 | 1.324 | −0.076 | 0.325 | 2.371 | −0.894 | 0.325 |
| 0.419 | 0.630 | 0.325 | 1.744 | −0.387 | 0.325 | 2.347 | −0.823 | 0.325 |
| 0.652 | 0.817 | 0.325 | 1.608 | 0.717 | 0.325 | 2.525 | −1.421 | 0.325 |
| 0.277 | 0.456 | 0.325 | 1.494 | 0.815 | 0.325 | 2.379 | −1.216 | 0.325 |
| 0.589 | 0.776 | 0.325 | 1.752 | 0.545 | 0.325 | 2.539 | −1.389 | 0.325 |
| 0.237 | 0.393 | 0.325 | 1.553 | 0.768 | 0.325 | 0.597 | 0.796 | 0.352 |
| 0.195 | 0.180 | 0.325 | 1.390 | −0.113 | 0.325 | 0.288 | 0.477 | 0.352 |
| 0.368 | 0.575 | 0.325 | 1.898 | −0.549 | 0.325 | 0.259 | 0.144 | 0.352 |
| 0.529 | 0.731 | 0.325 | 1.366 | 0.890 | 0.325 | 0.249 | 0.414 | 0.352 |
| 0.525 | 0.060 | 0.325 | 1.432 | 0.856 | 0.325 | 0.397 | 0.093 | 0.352 |
| 0.450 | 0.060 | 0.325 | 1.575 | −0.239 | 0.325 | 0.620 | 0.090 | 0.352 |
| 0.600 | 0.063 | 0.325 | 1.515 | −0.195 | 0.325 | 0.378 | 0.596 | 0.352 |
| 0.375 | 0.066 | 0.325 | 1.633 | −0.287 | 0.325 | 0.428 | 0.651 | 0.352 |
| 0.203 | 0.326 | 0.325 | 1.907 | 0.289 | 0.325 | 0.217 | 0.347 | 0.352 |

TABLE I-continued

| X | Y | Z' | X | Y | Z' | X | Y | Z' |
|---|---|---|---|---|---|---|---|---|
| 0.303 | 0.083 | 0.325 | 2.132 | −0.842 | 0.325 | 0.538 | 0.751 | 0.352 |
| 0.186 | 0.254 | 0.325 | 2.175 | −0.902 | 0.325 | 0.471 | 0.088 | 0.352 |
| 0.472 | 0.682 | 0.325 | 2.035 | 0.019 | 0.325 | 0.545 | 0.089 | 0.352 |
| 0.855 | 0.911 | 0.325 | 2.249 | −0.540 | 0.325 | 0.481 | 0.703 | 0.352 |
| 0.717 | 0.853 | 0.325 | 1.995 | −0.664 | 0.325 | 0.202 | 0.275 | 0.352 |
| 1.046 | 0.031 | 0.325 | 2.260 | −1.026 | 0.325 | 0.325 | 0.110 | 0.352 |
| 1.188 | −0.014 | 0.325 | 2.224 | −0.469 | 0.325 | 0.331 | 0.538 | 0.352 |
| 0.674 | 0.066 | 0.325 | 2.042 | −0.722 | 0.325 | 0.214 | 0.202 | 0.352 |
| 1.150 | 0.947 | 0.325 | 2.120 | −0.189 | 0.325 | 0.917 | 0.080 | 0.352 |
| 0.785 | 0.885 | 0.325 | 2.173 | −0.328 | 0.325 | 0.725 | 0.872 | 0.352 |
| 0.927 | 0.931 | 0.325 | 2.199 | −0.399 | 0.325 | 0.694 | 0.092 | 0.352 |
| 1.296 | 0.917 | 0.325 | 2.218 | −0.964 | 0.325 | 0.935 | 0.945 | 0.352 |
| 0.824 | 0.064 | 0.325 | 2.147 | −0.258 | 0.325 | 1.157 | 0.954 | 0.352 |
| 0.749 | 0.066 | 0.325 | 2.005 | 0.088 | 0.325 | 0.768 | 0.091 | 0.352 |
| 0.972 | 0.047 | 0.325 | 2.093 | −0.119 | 0.325 | 1.301 | 0.920 | 0.352 |
| 0.898 | 0.058 | 0.325 | 2.087 | −0.781 | 0.325 | 1.062 | 0.050 | 0.352 |
| 1.000 | 0.944 | 0.325 | 2.065 | −0.050 | 0.325 | 1.230 | 0.941 | 0.352 |
| 1.118 | 0.011 | 0.325 | 2.466 | −1.177 | 0.325 | 0.793 | 0.902 | 0.352 |
| 1.257 | −0.043 | 0.325 | 2.418 | −1.280 | 0.325 | 0.990 | 0.067 | 0.352 |
| 0.863 | 0.927 | 0.352 | 2.170 | −0.899 | 0.352 | 1.236 | 0.945 | 0.379 |
| 0.660 | 0.836 | 0.352 | 2.025 | 0.015 | 0.352 | 0.935 | 0.101 | 0.379 |
| 1.270 | −0.029 | 0.352 | 1.993 | −0.660 | 0.352 | 1.217 | 0.017 | 0.379 |
| 1.083 | 0.960 | 0.352 | 2.083 | −0.778 | 0.352 | 1.090 | 0.969 | 0.379 |
| 1.008 | 0.956 | 0.352 | 2.212 | −0.960 | 0.352 | 0.668 | 0.855 | 0.379 |
| 1.133 | 0.028 | 0.352 | 2.529 | −1.384 | 0.352 | 1.284 | −0.015 | 0.379 |
| 1.203 | 0.001 | 0.352 | 2.332 | −1.148 | 0.352 | 0.733 | 0.890 | 0.379 |
| 0.843 | 0.087 | 0.352 | 2.384 | −0.962 | 0.352 | 1.149 | 0.044 | 0.379 |
| 1.523 | −0.186 | 0.352 | 2.515 | −1.415 | 0.352 | 0.871 | 0.942 | 0.379 |
| 1.898 | −0.545 | 0.352 | 2.456 | −1.173 | 0.352 | 0.862 | 0.111 | 0.379 |
| 1.849 | −0.489 | 0.352 | 2.360 | −0.892 | 0.352 | 0.714 | 0.118 | 0.379 |
| 1.336 | −0.064 | 0.352 | 2.432 | −1.103 | 0.352 | 1.163 | 0.961 | 0.379 |
| 1.552 | 0.764 | 0.352 | 2.409 | −1.275 | 0.352 | 1.016 | 0.968 | 0.379 |
| 1.702 | 0.599 | 0.352 | 2.312 | −0.751 | 0.352 | 1.007 | 0.087 | 0.379 |
| 1.932 | 0.218 | 0.352 | 2.480 | −1.243 | 0.352 | 1.411 | −0.090 | 0.379 |
| 1.581 | −0.232 | 0.352 | 2.293 | −1.085 | 0.352 | 1.697 | −0.323 | 0.379 |
| 1.799 | −0.434 | 0.352 | 2.336 | −0.821 | 0.352 | 1.750 | −0.375 | 0.379 |
| 1.606 | 0.712 | 0.352 | 2.408 | −1.032 | 0.352 | 1.740 | 0.533 | 0.379 |
| 1.434 | 0.854 | 0.352 | 2.371 | −1.211 | 0.352 | 1.889 | 0.279 | 0.379 |
| 1.462 | −0.142 | 0.352 | 2.497 | −1.416 | 0.352 | 1.644 | −0.272 | 0.379 |
| 1.746 | 0.539 | 0.352 | 2.288 | −0.681 | 0.352 | 1.855 | 0.344 | 0.379 |
| 1.656 | 0.657 | 0.352 | 2.529 | −1.402 | 0.352 | 1.603 | 0.707 | 0.379 |
| 1.946 | −0.602 | 0.352 | 2.446 | −1.339 | 0.352 | 1.436 | 0.852 | 0.379 |
| 1.863 | 0.349 | 0.352 | 2.504 | −1.314 | 0.352 | 1.531 | −0.177 | 0.379 |
| 1.787 | 0.477 | 0.352 | 2.483 | −1.404 | 0.352 | 1.551 | 0.760 | 0.379 |
| 1.495 | 0.811 | 0.352 | 0.299 | 0.499 | 0.379 | 1.651 | 0.652 | 0.379 |
| 1.693 | −0.329 | 0.352 | 0.217 | 0.296 | 0.379 | 1.818 | 0.408 | 0.379 |
| 1.964 | 0.151 | 0.352 | 0.640 | 0.118 | 0.379 | 1.495 | 0.808 | 0.379 |
| 1.400 | −0.102 | 0.352 | 0.346 | 0.137 | 0.379 | 1.850 | −0.484 | 0.379 |
| 1.898 | 0.284 | 0.352 | 0.566 | 0.117 | 0.379 | 1.780 | 0.472 | 0.379 |
| 1.747 | −0.381 | 0.352 | 0.233 | 0.225 | 0.379 | 1.349 | −0.051 | 0.379 |
| 1.826 | 0.414 | 0.352 | 0.546 | 0.772 | 0.379 | 1.945 | −0.597 | 0.379 |
| 1.638 | −0.280 | 0.352 | 0.280 | 0.169 | 0.379 | 1.372 | 0.890 | 0.379 |
| 1.369 | 0.890 | 0.352 | 0.341 | 0.560 | 0.379 | 1.898 | −0.540 | 0.379 |
| 2.039 | −0.718 | 0.352 | 0.387 | 0.618 | 0.379 | 1.697 | 0.594 | 0.379 |
| 2.239 | −0.540 | 0.352 | 0.605 | 0.816 | 0.379 | 1.472 | −0.132 | 0.379 |
| 2.110 | −0.191 | 0.352 | 0.230 | 0.369 | 0.379 | 1.800 | −0.429 | 0.379 |
| 2.127 | −0.838 | 0.352 | 0.419 | 0.123 | 0.379 | 1.954 | 0.146 | 0.379 |
| 2.054 | −0.053 | 0.352 | 0.493 | 0.118 | 0.379 | 1.922 | 0.213 | 0.379 |
| 2.188 | −0.400 | 0.352 | 0.261 | 0.436 | 0.379 | 1.588 | −0.223 | 0.379 |
| 2.137 | −0.261 | 0.352 | 0.437 | 0.672 | 0.379 | 2.164 | −0.894 | 0.379 |
| 2.253 | −1.022 | 0.352 | 0.490 | 0.724 | 0.379 | 2.277 | −0.680 | 0.379 |
| 2.263 | −0.610 | 0.352 | 0.943 | 0.959 | 0.379 | 2.400 | −1.269 | 0.379 |
| 1.995 | 0.083 | 0.352 | 0.788 | 0.116 | 0.379 | 2.099 | −0.194 | 0.379 |
| 2.163 | −0.330 | 0.352 | 1.305 | 0.922 | 0.379 | 2.285 | −1.080 | 0.379 |
| 2.083 | −0.122 | 0.352 | 1.079 | 0.068 | 0.379 | 1.991 | −0.655 | 0.379 |
| 2.214 | −0.470 | 0.352 | 0.801 | 0.919 | 0.379 | 2.228 | −0.540 | 0.379 |
| 2.505 | −1.408 | 0.379 | 0.950 | 0.972 | 0.406 | 2.088 | −0.196 | 0.406 |
| 2.152 | −0.332 | 0.379 | 1.241 | 0.949 | 0.406 | 2.075 | −0.768 | 0.406 |
| 2.203 | −0.471 | 0.379 | 1.164 | 0.060 | 0.406 | 2.216 | −0.539 | 0.406 |
| 2.252 | −0.610 | 0.379 | 0.675 | 0.874 | 0.406 | 2.199 | −0.950 | 0.406 |
| 2.362 | −1.206 | 0.379 | 1.170 | 0.967 | 0.406 | 2.166 | −0.402 | 0.406 |
| 2.445 | −1.168 | 0.379 | 1.297 | −0.002 | 0.406 | 2.117 | −0.828 | 0.406 |
| 2.177 | −0.401 | 0.379 | 1.095 | 0.085 | 0.406 | 2.158 | −0.889 | 0.406 |
| 2.301 | −0.749 | 0.379 | 0.741 | 0.907 | 0.406 | 2.238 | −1.012 | 0.406 |
| 2.325 | −0.819 | 0.379 | 0.953 | 0.122 | 0.406 | 2.033 | −0.060 | 0.406 |
| 2.044 | −0.057 | 0.379 | 0.880 | 0.133 | 0.406 | 2.114 | −0.264 | 0.406 |
| 2.349 | −0.889 | 0.379 | 0.661 | 0.146 | 0.406 | 2.004 | 0.008 | 0.406 |

TABLE I-continued

| X | Y | Z' | X | Y | Z' | X | Y | Z' |
|---|---|---|---|---|---|---|---|---|
| 2.437 | −1.333 | 0.379 | 0.808 | 0.935 | 0.406 | 2.140 | −0.333 | 0.406 |
| 2.469 | −1.238 | 0.379 | 1.309 | 0.923 | 0.406 | 2.265 | −0.678 | 0.406 |
| 2.072 | −0.125 | 0.379 | 0.807 | 0.140 | 0.406 | 1.988 | −0.649 | 0.406 |
| 2.397 | −1.029 | 0.379 | 0.734 | 0.144 | 0.406 | 2.060 | −0.128 | 0.406 |
| 2.079 | −0.773 | 0.379 | 0.879 | 0.957 | 0.406 | 2.241 | −0.609 | 0.406 |
| 2.494 | −1.308 | 0.379 | 1.023 | 0.979 | 0.406 | 2.191 | −0.470 | 0.406 |
| 2.015 | 0.011 | 0.379 | 1.025 | 0.106 | 0.406 | 2.032 | −0.708 | 0.406 |
| 2.036 | −0.713 | 0.379 | 1.097 | 0.977 | 0.406 | 2.410 | −1.094 | 0.406 |
| 2.246 | −1.017 | 0.379 | 1.231 | 0.031 | 0.406 | 2.477 | −1.401 | 0.406 |
| 2.122 | −0.833 | 0.379 | 1.539 | −0.167 | 0.406 | 2.427 | −1.326 | 0.406 |
| 1.985 | 0.079 | 0.379 | 1.595 | −0.214 | 0.406 | 2.290 | −0.747 | 0.406 |
| 2.421 | −1.099 | 0.379 | 1.360 | −0.039 | 0.406 | 2.338 | −0.886 | 0.406 |
| 2.487 | −1.409 | 0.379 | 1.494 | 0.805 | 0.406 | 2.314 | −0.816 | 0.406 |
| 2.324 | −1.142 | 0.379 | 1.803 | −0.422 | 0.406 | 2.507 | −1.388 | 0.406 |
| 2.518 | −1.396 | 0.379 | 1.851 | −0.477 | 0.406 | 2.495 | −1.400 | 0.406 |
| 2.205 | −0.955 | 0.379 | 1.548 | 0.756 | 0.406 | 2.507 | −1.371 | 0.406 |
| 2.518 | −1.378 | 0.379 | 1.912 | 0.208 | 0.406 | 2.362 | −0.955 | 0.406 |
| 2.126 | −0.263 | 0.379 | 1.691 | 0.588 | 0.406 | 2.390 | −1.263 | 0.406 |
| 2.373 | −0.959 | 0.379 | 1.879 | 0.274 | 0.406 | 2.483 | −1.301 | 0.406 |
| 2.473 | −1.397 | 0.379 | 1.481 | −0.122 | 0.406 | 2.463 | −1.390 | 0.406 |
| 0.369 | 0.166 | 0.406 | 1.845 | 0.339 | 0.406 | 2.386 | −1.024 | 0.406 |
| 0.396 | 0.639 | 0.406 | 1.599 | 0.703 | 0.406 | 2.277 | −1.074 | 0.406 |
| 0.445 | 0.693 | 0.406 | 1.436 | 0.851 | 0.406 | 2.315 | −1.136 | 0.406 |
| 0.587 | 0.146 | 0.406 | 1.650 | −0.264 | 0.406 | 2.434 | −1.163 | 0.406 |
| 0.251 | 0.247 | 0.406 | 1.944 | 0.142 | 0.406 | 2.353 | −1.199 | 0.406 |
| 0.498 | 0.744 | 0.406 | 1.898 | −0.534 | 0.406 | 2.458 | −1.232 | 0.406 |
| 0.243 | 0.390 | 0.406 | 1.974 | 0.075 | 0.406 | 0.283 | 0.479 | 0.433 |
| 0.441 | 0.153 | 0.406 | 1.944 | −0.591 | 0.406 | 0.390 | 0.195 | 0.433 |
| 0.351 | 0.581 | 0.406 | 1.772 | 0.466 | 0.406 | 0.320 | 0.542 | 0.433 |
| 0.232 | 0.317 | 0.406 | 1.702 | −0.315 | 0.406 | 0.322 | 0.221 | 0.433 |
| 0.514 | 0.148 | 0.406 | 1.733 | 0.528 | 0.406 | 0.360 | 0.602 | 0.433 |
| 0.310 | 0.520 | 0.406 | 1.810 | 0.403 | 0.406 | 0.506 | 0.765 | 0.433 |
| 0.272 | 0.457 | 0.406 | 1.422 | −0.079 | 0.406 | 0.270 | 0.271 | 0.433 |
| 0.301 | 0.195 | 0.406 | 1.753 | −0.368 | 0.406 | 0.462 | 0.183 | 0.433 |
| 0.613 | 0.835 | 0.406 | 1.375 | 0.890 | 0.406 | 0.608 | 0.176 | 0.433 |
| 0.554 | 0.792 | 0.406 | 1.646 | 0.647 | 0.406 | 0.562 | 0.812 | 0.433 |
| 0.405 | 0.660 | 0.433 | 1.370 | −0.027 | 0.433 | 0.369 | 0.624 | 0.460 |
| 0.248 | 0.339 | 0.433 | 1.850 | −0.471 | 0.433 | 0.288 | 0.295 | 0.460 |
| 0.535 | 0.178 | 0.433 | 1.764 | 0.461 | 0.433 | 0.411 | 0.224 | 0.460 |
| 0.454 | 0.714 | 0.433 | 1.869 | 0.270 | 0.433 | 0.462 | 0.735 | 0.460 |
| 0.621 | 0.854 | 0.433 | 1.836 | 0.334 | 0.433 | 0.343 | 0.248 | 0.460 |
| 0.256 | 0.411 | 0.433 | 1.684 | 0.583 | 0.433 | 0.570 | 0.832 | 0.460 |
| 1.175 | 0.973 | 0.433 | 2.229 | −0.607 | 0.433 | 0.268 | 0.433 | 0.460 |
| 1.110 | 0.102 | 0.433 | 2.230 | −1.005 | 0.433 | 0.294 | 0.501 | 0.460 |
| 0.753 | 0.170 | 0.433 | 2.152 | −0.883 | 0.433 | 0.627 | 0.205 | 0.460 |
| 0.683 | 0.892 | 0.433 | 2.070 | −0.762 | 0.433 | 0.483 | 0.214 | 0.460 |
| 1.104 | 0.985 | 0.433 | 2.102 | −0.265 | 0.433 | 0.263 | 0.362 | 0.460 |
| 1.178 | 0.076 | 0.433 | 2.076 | −0.197 | 0.433 | 0.413 | 0.682 | 0.460 |
| 0.886 | 0.971 | 0.433 | 2.049 | −0.129 | 0.433 | 1.124 | 0.119 | 0.460 |
| 0.749 | 0.925 | 0.433 | 2.111 | −0.822 | 0.433 | 0.699 | 0.201 | 0.460 |
| 0.680 | 0.173 | 0.433 | 2.154 | −0.401 | 0.433 | 0.824 | 0.967 | 0.460 |
| 1.244 | 0.045 | 0.433 | 2.204 | −0.538 | 0.433 | 0.772 | 0.196 | 0.460 |
| 0.898 | 0.156 | 0.433 | 2.254 | −0.675 | 0.433 | 1.110 | 0.993 | 0.460 |
| 0.816 | 0.951 | 0.433 | 2.179 | −0.470 | 0.433 | 1.191 | 0.091 | 0.460 |
| 1.308 | 0.011 | 0.433 | 1.993 | 0.005 | 0.433 | 0.966 | 0.996 | 0.460 |
| 0.826 | 0.165 | 0.433 | 1.985 | −0.643 | 0.433 | 1.255 | 0.059 | 0.460 |
| 0.970 | 0.142 | 0.433 | 2.191 | −0.944 | 0.433 | 1.249 | 0.956 | 0.460 |
| 0.958 | 0.984 | 0.433 | 2.028 | −0.702 | 0.433 | 0.844 | 0.188 | 0.460 |
| 1.245 | 0.953 | 0.433 | 2.128 | −0.333 | 0.433 | 1.038 | 0.999 | 0.460 |
| 1.041 | 0.125 | 0.433 | 2.021 | −0.062 | 0.433 | 0.691 | 0.911 | 0.460 |
| 1.031 | 0.989 | 0.433 | 2.306 | −1.130 | 0.433 | 0.915 | 0.177 | 0.460 |
| 1.431 | −0.068 | 0.433 | 2.496 | −1.380 | 0.433 | 0.986 | 0.162 | 0.460 |
| 1.896 | −0.528 | 0.433 | 2.302 | −0.813 | 0.433 | 0.894 | 0.986 | 0.460 |
| 1.801 | 0.398 | 0.433 | 2.375 | −1.019 | 0.433 | 0.756 | 0.942 | 0.460 |
| 1.963 | 0.072 | 0.433 | 2.417 | −1.318 | 0.433 | 1.181 | 0.979 | 0.460 |
| 1.725 | 0.523 | 0.433 | 2.278 | −0.744 | 0.433 | 1.056 | 0.143 | 0.460 |
| 1.704 | −0.308 | 0.433 | 2.423 | −1.157 | 0.433 | 1.802 | −0.409 | 0.460 |
| 1.653 | −0.257 | 0.433 | 2.466 | −1.393 | 0.433 | 1.635 | 0.637 | 0.460 |
| 1.803 | −0.416 | 0.433 | 2.269 | −1.067 | 0.433 | 1.938 | −0.579 | 0.460 |
| 1.377 | 0.890 | 0.433 | 2.381 | −1.255 | 0.433 | 1.891 | 0.201 | 0.460 |
| 1.545 | −0.158 | 0.433 | 2.453 | −1.382 | 0.433 | 1.436 | 0.847 | 0.460 |
| 1.437 | 0.849 | 0.433 | 2.447 | −1.225 | 0.433 | 1.495 | −0.103 | 0.460 |
| 1.546 | 0.752 | 0.433 | 2.496 | −1.363 | 0.433 | 1.604 | −0.199 | 0.460 |
| 1.641 | 0.642 | 0.433 | 2.351 | −0.950 | 0.433 | 1.706 | −0.301 | 0.460 |
| 1.754 | −0.361 | 0.433 | 2.484 | −1.392 | 0.433 | 1.491 | 0.799 | 0.460 |
| 1.600 | −0.207 | 0.433 | 2.344 | −1.192 | 0.433 | 1.922 | 0.135 | 0.460 |
| 1.595 | 0.698 | 0.433 | 2.327 | −0.881 | 0.433 | 1.755 | 0.457 | 0.460 |

TABLE I-continued

| X | Y | Z' | X | Y | Z' | X | Y | Z' |
|---|---|---|---|---|---|---|---|---|
| 1.933 | 0.138 | 0.433 | 2.472 | −1.294 | 0.433 | 1.849 | −0.465 | 0.460 |
| 1.941 | −0.585 | 0.433 | 2.399 | −1.088 | 0.433 | 1.379 | −0.016 | 0.460 |
| 1.902 | 0.204 | 0.433 | 0.555 | 0.209 | 0.460 | 1.542 | 0.748 | 0.460 |
| 1.493 | 0.802 | 0.433 | 0.329 | 0.564 | 0.460 | 1.717 | 0.518 | 0.460 |
| 1.489 | −0.112 | 0.433 | 0.514 | 0.786 | 0.460 | 1.791 | 0.394 | 0.460 |
| 1.313 | 0.925 | 0.433 | 0.629 | 0.874 | 0.460 | 1.952 | 0.070 | 0.460 |
| 1.656 | −0.249 | 0.460 | 2.406 | −1.310 | 0.460 | 1.670 | 0.574 | 0.487 |
| 1.677 | 0.579 | 0.460 | 2.266 | −0.740 | 0.460 | 1.746 | 0.453 | 0.487 |
| 1.590 | 0.694 | 0.460 | 0.575 | 0.239 | 0.487 | 1.848 | 0.263 | 0.487 |
| 1.894 | −0.521 | 0.460 | 0.364 | 0.276 | 0.487 | 1.445 | −0.048 | 0.487 |
| 1.318 | 0.023 | 0.460 | 0.432 | 0.255 | 0.487 | 1.500 | −0.094 | 0.487 |
| 1.755 | −0.355 | 0.460 | 0.280 | 0.456 | 0.487 | 1.317 | 0.927 | 0.487 |
| 1.826 | 0.330 | 0.460 | 0.307 | 0.320 | 0.487 | 1.846 | −0.458 | 0.487 |
| 1.315 | 0.926 | 0.460 | 0.278 | 0.384 | 0.487 | 1.554 | −0.141 | 0.487 |
| 1.438 | −0.058 | 0.460 | 0.636 | 0.893 | 0.487 | 1.754 | −0.348 | 0.487 |
| 1.378 | 0.889 | 0.460 | 0.646 | 0.234 | 0.487 | 1.435 | 0.845 | 0.487 |
| 1.550 | −0.150 | 0.460 | 0.503 | 0.245 | 0.487 | 1.879 | 0.198 | 0.487 |
| 1.859 | 0.266 | 0.460 | 0.422 | 0.704 | 0.487 | 1.933 | −0.572 | 0.487 |
| 2.183 | −0.937 | 0.460 | 0.470 | 0.757 | 0.487 | 1.378 | 0.889 | 0.487 |
| 2.064 | −0.756 | 0.460 | 0.522 | 0.807 | 0.487 | 1.328 | 0.035 | 0.487 |
| 2.167 | −0.468 | 0.460 | 0.304 | 0.524 | 0.487 | 1.781 | 0.390 | 0.487 |
| 2.037 | −0.130 | 0.460 | 0.378 | 0.647 | 0.487 | 1.387 | −0.005 | 0.487 |
| 2.064 | −0.198 | 0.460 | 0.339 | 0.586 | 0.487 | 1.628 | 0.633 | 0.487 |
| 2.023 | −0.696 | 0.460 | 0.577 | 0.852 | 0.487 | 1.709 | 0.514 | 0.487 |
| 1.981 | 0.003 | 0.460 | 1.266 | 0.072 | 0.487 | 1.940 | 0.068 | 0.487 |
| 2.192 | −0.536 | 0.460 | 0.764 | 0.959 | 0.487 | 1.657 | −0.242 | 0.487 |
| 2.217 | −0.604 | 0.460 | 1.044 | 1.009 | 0.487 | 2.229 | −0.668 | 0.487 |
| 2.090 | −0.265 | 0.460 | 0.861 | 0.212 | 0.487 | 2.017 | −0.689 | 0.487 |
| 2.242 | −0.672 | 0.460 | 1.202 | 0.105 | 0.487 | 2.175 | −0.930 | 0.487 |
| 2.144 | −0.876 | 0.460 | 1.137 | 0.135 | 0.487 | 2.179 | −0.533 | 0.487 |
| 1.981 | −0.637 | 0.460 | 1.253 | 0.959 | 0.487 | 2.051 | −0.197 | 0.487 |
| 2.116 | −0.332 | 0.460 | 0.931 | 0.199 | 0.487 | 2.250 | −1.052 | 0.487 |
| 2.260 | −1.060 | 0.460 | 0.790 | 0.222 | 0.487 | 2.204 | −0.600 | 0.487 |
| 2.222 | −0.998 | 0.460 | 0.831 | 0.983 | 0.487 | 2.024 | −0.131 | 0.487 |
| 2.142 | −0.400 | 0.460 | 1.001 | 0.182 | 0.487 | 2.254 | −0.735 | 0.487 |
| 2.104 | −0.816 | 0.460 | 0.698 | 0.929 | 0.487 | 2.097 | −0.809 | 0.487 |
| 2.009 | −0.063 | 0.460 | 1.116 | 1.001 | 0.487 | 2.077 | −0.264 | 0.487 |
| 2.435 | −1.218 | 0.460 | 0.973 | 1.008 | 0.487 | 1.997 | −0.064 | 0.487 |
| 2.339 | −0.945 | 0.460 | 1.070 | 0.161 | 0.487 | 2.212 | −0.991 | 0.487 |
| 2.297 | −1.122 | 0.460 | 1.186 | 0.984 | 0.487 | 2.103 | −0.331 | 0.487 |
| 2.442 | −1.372 | 0.460 | 0.901 | 1.000 | 0.487 | 2.154 | −0.466 | 0.487 |
| 2.334 | −1.184 | 0.460 | 0.718 | 0.228 | 0.487 | 2.057 | −0.749 | 0.487 |
| 2.363 | −1.013 | 0.460 | 1.910 | 0.133 | 0.487 | 2.129 | −0.398 | 0.487 |
| 2.387 | −1.081 | 0.460 | 1.801 | −0.403 | 0.487 | 2.136 | −0.869 | 0.487 |
| 2.455 | −1.383 | 0.460 | 1.890 | −0.515 | 0.487 | 2.447 | −1.277 | 0.487 |
| 2.411 | −1.149 | 0.460 | 1.585 | 0.690 | 0.487 | 2.287 | −1.114 | 0.487 |
| 2.315 | −0.876 | 0.460 | 1.606 | −0.191 | 0.487 | 2.423 | −1.209 | 0.487 |
| 2.370 | −1.247 | 0.460 | 1.538 | 0.745 | 0.487 | 2.472 | −1.344 | 0.487 |
| 2.484 | −1.371 | 0.460 | 1.706 | −0.294 | 0.487 | 2.460 | −1.372 | 0.487 |
| 2.460 | −1.286 | 0.460 | 1.815 | 0.327 | 0.487 | 2.278 | −0.803 | 0.487 |
| 2.472 | −1.382 | 0.460 | 1.968 | 0.002 | 0.487 | 2.395 | −1.300 | 0.487 |
| 2.290 | −0.808 | 0.460 | 1.975 | −0.631 | 0.487 | 2.326 | −0.938 | 0.487 |
| 2.484 | −1.354 | 0.460 | 1.488 | 0.797 | 0.487 | 2.399 | −1.141 | 0.487 |
| 2.444 | −1.373 | 0.487 | 1.557 | −0.133 | 0.514 | 2.384 | −1.289 | 0.514 |
| 2.375 | −1.074 | 0.487 | 1.450 | −0.038 | 0.514 | 2.459 | −1.333 | 0.514 |
| 2.350 | −1.006 | 0.487 | 1.433 | 0.843 | 0.514 | 2.338 | −0.998 | 0.514 |
| 2.431 | −1.362 | 0.487 | 1.378 | 0.888 | 0.514 | 2.216 | −0.663 | 0.514 |
| 2.472 | −1.361 | 0.487 | 1.485 | 0.794 | 0.514 | 2.432 | −1.362 | 0.514 |
| 2.302 | −0.871 | 0.487 | 1.319 | 0.928 | 0.514 | 2.348 | −1.228 | 0.514 |
| 2.323 | −1.176 | 0.487 | 1.804 | 0.324 | 0.514 | 2.459 | −1.350 | 0.514 |
| 2.359 | −1.238 | 0.487 | 1.842 | −0.452 | 0.514 | 2.419 | −1.351 | 0.514 |
| 0.325 | 0.346 | 0.514 | 1.752 | −0.341 | 0.514 | 2.276 | −1.105 | 0.514 |
| 0.477 | 0.779 | 0.514 | 1.771 | 0.387 | 0.514 | 2.203 | −0.982 | 0.514 |
| 0.292 | 0.479 | 0.514 | 1.658 | −0.234 | 0.514 | 2.362 | −1.065 | 0.514 |
| 0.293 | 0.408 | 0.514 | 1.736 | 0.449 | 0.514 | 2.241 | −0.730 | 0.514 |
| 0.347 | 0.609 | 0.514 | 1.608 | −0.183 | 0.514 | 2.386 | −1.132 | 0.514 |
| 0.665 | 0.263 | 0.514 | 1.661 | 0.571 | 0.514 | 2.265 | −0.797 | 0.514 |
| 0.584 | 0.873 | 0.514 | 1.798 | −0.396 | 0.514 | 0.322 | 0.571 | 0.541 |
| 0.595 | 0.270 | 0.514 | 1.621 | 0.629 | 0.514 | 0.394 | 0.692 | 0.541 |
| 0.736 | 0.256 | 0.514 | 1.706 | −0.287 | 0.514 | 0.651 | 0.932 | 0.541 |
| 0.644 | 0.913 | 0.514 | 1.836 | 0.260 | 0.514 | 0.755 | 0.284 | 0.541 |
| 0.429 | 0.726 | 0.514 | 1.700 | 0.510 | 0.514 | 0.308 | 0.433 | 0.541 |
| 0.529 | 0.828 | 0.514 | 1.867 | 0.196 | 0.514 | 0.345 | 0.374 | 0.541 |
| 0.384 | 0.306 | 0.514 | 1.885 | −0.508 | 0.514 | 0.303 | 0.503 | 0.541 |
| 0.706 | 0.947 | 0.514 | 2.166 | −0.529 | 0.514 | 0.474 | 0.321 | 0.541 |
| 0.313 | 0.547 | 0.514 | 2.038 | −0.197 | 0.514 | 0.537 | 0.849 | 0.541 |
| 0.386 | 0.669 | 0.514 | 2.127 | −0.861 | 0.514 | 0.714 | 0.965 | 0.541 |

TABLE I-continued

| X | Y | Z' | X | Y | Z' | X | Y | Z' |
|---|---|---|---|---|---|---|---|---|
| 0.771 | 0.976 | 0.514 | 2.116 | −0.396 | 0.514 | 0.592 | 0.893 | 0.541 |
| 0.524 | 0.278 | 0.514 | 2.010 | −0.682 | 0.514 | 0.405 | 0.338 | 0.541 |
| 0.453 | 0.287 | 0.514 | 1.969 | −0.624 | 0.514 | 0.437 | 0.749 | 0.541 |
| 1.121 | 1.008 | 0.514 | 1.928 | −0.566 | 0.514 | 0.356 | 0.633 | 0.541 |
| 1.016 | 0.201 | 0.514 | 1.898 | 0.131 | 0.514 | 0.485 | 0.801 | 0.541 |
| 1.084 | 0.178 | 0.514 | 2.089 | −0.801 | 0.514 | 0.779 | 0.992 | 0.541 |
| 0.979 | 1.020 | 0.514 | 2.064 | −0.263 | 0.514 | 0.685 | 0.294 | 0.541 |
| 1.150 | 0.151 | 0.514 | 2.165 | −0.922 | 0.514 | 0.544 | 0.312 | 0.541 |
| 1.190 | 0.989 | 0.514 | 1.927 | 0.066 | 0.514 | 0.614 | 0.303 | 0.541 |
| 0.947 | 0.220 | 0.514 | 2.141 | −0.462 | 0.514 | 1.194 | 0.993 | 0.541 |
| 1.214 | 0.120 | 0.514 | 2.050 | −0.741 | 0.514 | 1.057 | 1.027 | 0.541 |
| 1.256 | 0.962 | 0.514 | 2.011 | −0.130 | 0.514 | 0.916 | 1.026 | 0.541 |
| 0.878 | 0.235 | 0.514 | 2.090 | −0.329 | 0.514 | 1.096 | 0.195 | 0.541 |
| 1.051 | 1.018 | 0.514 | 1.984 | −0.065 | 0.514 | 0.846 | 1.013 | 0.541 |
| 0.908 | 1.013 | 0.514 | 1.956 | 0.001 | 0.514 | 1.127 | 1.014 | 0.541 |
| 0.807 | 0.247 | 0.514 | 2.448 | −1.361 | 0.514 | 0.824 | 0.272 | 0.541 |
| 0.839 | 0.998 | 0.514 | 2.410 | −1.199 | 0.514 | 1.284 | 0.097 | 0.541 |
| 1.276 | 0.085 | 0.514 | 2.289 | −0.864 | 0.514 | 1.259 | 0.964 | 0.541 |
| 1.394 | 0.006 | 0.514 | 2.240 | −1.043 | 0.514 | 1.161 | 0.166 | 0.541 |
| 1.578 | 0.687 | 0.514 | 2.435 | −1.266 | 0.514 | 0.894 | 0.257 | 0.541 |
| 1.336 | 0.047 | 0.514 | 2.314 | −0.931 | 0.514 | 1.030 | 0.219 | 0.541 |
| 1.533 | 0.742 | 0.514 | 2.191 | −0.596 | 0.514 | 0.987 | 1.030 | 0.541 |
| 1.505 | −0.085 | 0.514 | 2.312 | −1.166 | 0.514 | 0.962 | 0.240 | 0.541 |
| 1.224 | 0.133 | 0.541 | 2.446 | −1.322 | 0.541 | 0.840 | 0.296 | 0.568 |
| 1.508 | −0.076 | 0.541 | 2.447 | −1.338 | 0.541 | 0.975 | 0.259 | 0.568 |
| 1.320 | 0.928 | 0.541 | 2.227 | −0.724 | 0.541 | 1.198 | 0.996 | 0.568 |
| 1.377 | 0.887 | 0.541 | 2.276 | −0.857 | 0.541 | 1.041 | 0.235 | 0.568 |
| 1.455 | −0.029 | 0.541 | 2.300 | −0.923 | 0.541 | 0.994 | 1.040 | 0.568 |
| 1.400 | 0.015 | 0.541 | 2.336 | −1.217 | 0.541 | 1.064 | 1.033 | 0.568 |
| 1.528 | 0.738 | 0.541 | 2.178 | −0.591 | 0.541 | 0.854 | 1.027 | 0.568 |
| 1.572 | 0.683 | 0.541 | 2.203 | −0.658 | 0.541 | 1.455 | −0.023 | 0.568 |
| 1.343 | 0.058 | 0.541 | 2.325 | −0.990 | 0.541 | 1.346 | 0.066 | 0.568 |
| 1.431 | 0.841 | 0.541 | 2.252 | −0.790 | 0.541 | 1.522 | 0.734 | 0.568 |
| 1.481 | 0.791 | 0.541 | 2.407 | −1.339 | 0.541 | 1.565 | 0.678 | 0.568 |
| 1.559 | −0.125 | 0.541 | 2.435 | −1.349 | 0.541 | 1.402 | 0.023 | 0.568 |
| 1.704 | −0.280 | 0.541 | 2.229 | −1.034 | 0.541 | 1.477 | 0.787 | 0.568 |
| 1.613 | 0.625 | 0.541 | 2.192 | −0.973 | 0.541 | 1.507 | −0.070 | 0.568 |
| 1.726 | 0.445 | 0.541 | 2.372 | −1.278 | 0.541 | 1.376 | 0.885 | 0.568 |
| 1.855 | 0.194 | 0.541 | 2.419 | −1.350 | 0.541 | 1.428 | 0.838 | 0.568 |
| 1.653 | 0.566 | 0.541 | 2.397 | −1.189 | 0.541 | 1.557 | −0.119 | 0.568 |
| 1.690 | 0.506 | 0.541 | 2.265 | −1.095 | 0.541 | 1.321 | 0.928 | 0.568 |
| 1.824 | 0.257 | 0.541 | 2.422 | −1.256 | 0.541 | 1.872 | 0.128 | 0.568 |
| 1.793 | 0.321 | 0.541 | 2.349 | −1.056 | 0.541 | 1.680 | 0.502 | 0.568 |
| 1.880 | −0.502 | 0.541 | 0.364 | 0.404 | 0.568 | 1.812 | 0.255 | 0.568 |
| 1.657 | −0.227 | 0.541 | 0.322 | 0.459 | 0.568 | 1.830 | −0.439 | 0.568 |
| 1.609 | −0.175 | 0.541 | 0.426 | 0.373 | 0.568 | 1.843 | 0.192 | 0.568 |
| 1.837 | −0.445 | 0.541 | 0.721 | 0.983 | 0.568 | 1.653 | −0.222 | 0.568 |
| 1.794 | −0.389 | 0.541 | 0.331 | 0.596 | 0.568 | 1.715 | 0.442 | 0.568 |
| 1.749 | −0.334 | 0.541 | 0.445 | 0.772 | 0.568 | 1.872 | −0.496 | 0.568 |
| 1.760 | 0.383 | 0.541 | 0.363 | 0.658 | 0.568 | 1.606 | 0.621 | 0.568 |
| 1.998 | −0.130 | 0.541 | 0.494 | 0.358 | 0.568 | 1.787 | −0.384 | 0.568 |
| 2.155 | −0.913 | 0.541 | 0.633 | 0.336 | 0.568 | 1.781 | 0.318 | 0.568 |
| 1.914 | 0.065 | 0.541 | 0.659 | 0.951 | 0.568 | 1.699 | −0.275 | 0.568 |
| 1.921 | −0.559 | 0.541 | 0.313 | 0.528 | 0.568 | 1.644 | 0.562 | 0.568 |
| 2.041 | −0.734 | 0.541 | 0.544 | 0.871 | 0.568 | 1.606 | −0.170 | 0.568 |
| 2.103 | −0.393 | 0.541 | 0.600 | 0.914 | 0.568 | 1.749 | 0.380 | 0.568 |
| 2.077 | −0.327 | 0.541 | 0.492 | 0.824 | 0.568 | 1.744 | −0.329 | 0.568 |
| 1.943 | 0.000 | 0.541 | 0.787 | 1.008 | 0.568 | 2.114 | −0.455 | 0.568 |
| 2.002 | −0.675 | 0.541 | 0.402 | 0.717 | 0.568 | 1.993 | −0.668 | 0.568 |
| 2.080 | −0.793 | 0.541 | 0.564 | 0.348 | 0.568 | 2.070 | −0.785 | 0.568 |
| 2.118 | −0.853 | 0.541 | 0.702 | 0.324 | 0.568 | 1.930 | 0.000 | 0.568 |
| 1.885 | 0.130 | 0.541 | 0.771 | 0.311 | 0.568 | 2.031 | −0.726 | 0.568 |
| 2.128 | −0.459 | 0.541 | 1.230 | 0.143 | 0.568 | 2.011 | −0.194 | 0.568 |
| 2.153 | −0.525 | 0.541 | 1.168 | 0.177 | 0.568 | 2.089 | −0.390 | 0.568 |
| 1.962 | −0.617 | 0.541 | 0.924 | 1.037 | 0.568 | 2.063 | −0.324 | 0.568 |
| 2.025 | −0.196 | 0.541 | 1.105 | 0.208 | 0.568 | 1.901 | 0.064 | 0.568 |
| 1.971 | −0.065 | 0.541 | 1.261 | 0.965 | 0.568 | 1.984 | −0.129 | 0.568 |
| 2.051 | −0.261 | 0.541 | 1.289 | 0.106 | 0.568 | 2.037 | −0.259 | 0.568 |
| 2.373 | −1.123 | 0.541 | 0.908 | 0.279 | 0.568 | 1.913 | −0.553 | 0.568 |
| 2.301 | −1.156 | 0.541 | 1.132 | 1.019 | 0.568 | 2.107 | −0.845 | 0.568 |
| 1.957 | −0.065 | 0.568 | 1.001 | 1.048 | 0.595 | 2.168 | −0.954 | 0.595 |
| 2.164 | −0.586 | 0.568 | 0.919 | 0.300 | 0.595 | 2.131 | −0.895 | 0.595 |
| 1.953 | −0.610 | 0.568 | 1.232 | 0.150 | 0.595 | 1.916 | 0.000 | 0.595 |
| 2.139 | −0.521 | 0.568 | 1.070 | 1.039 | 0.595 | 1.944 | −0.064 | 0.595 |
| 2.144 | −0.904 | 0.568 | 0.853 | 0.320 | 0.595 | 2.057 | −0.777 | 0.595 |
| 2.263 | −0.849 | 0.568 | 1.172 | 0.186 | 0.595 | 2.075 | −0.385 | 0.595 |
| 2.384 | −1.178 | 0.568 | 1.049 | 0.250 | 0.595 | 2.019 | −0.719 | 0.595 |

TABLE I-continued

| X | Y | Z' | X | Y | Z' | X | Y | Z' |
|---|---|---|---|---|---|---|---|---|
| 2.189 | −0.652 | 0.568 | 1.137 | 1.022 | 0.595 | 1.888 | 0.064 | 0.595 |
| 2.253 | −1.084 | 0.568 | 1.111 | 0.220 | 0.595 | 1.971 | −0.128 | 0.595 |
| 2.214 | −0.717 | 0.568 | 1.202 | 0.997 | 0.595 | 2.100 | −0.450 | 0.595 |
| 2.217 | −1.024 | 0.568 | 0.863 | 1.040 | 0.595 | 1.981 | −0.661 | 0.595 |
| 2.408 | −1.244 | 0.568 | 1.263 | 0.964 | 0.595 | 1.901 | −0.547 | 0.595 |
| 2.433 | −1.325 | 0.568 | 0.932 | 1.048 | 0.595 | 2.273 | −0.905 | 0.595 |
| 2.422 | −1.336 | 0.568 | 1.321 | 0.926 | 0.595 | 2.175 | −0.645 | 0.595 |
| 2.288 | −1.145 | 0.568 | 1.598 | 0.617 | 0.595 | 2.394 | −1.230 | 0.595 |
| 2.181 | −0.964 | 0.568 | 1.375 | 0.882 | 0.595 | 2.204 | −1.013 | 0.595 |
| 2.360 | −1.112 | 0.568 | 1.345 | 0.070 | 0.595 | 2.345 | −1.252 | 0.595 |
| 2.324 | −1.205 | 0.568 | 1.425 | 0.834 | 0.595 | 2.381 | −1.312 | 0.595 |
| 2.335 | −1.046 | 0.568 | 1.502 | −0.067 | 0.595 | 2.224 | −0.775 | 0.595 |
| 2.433 | −1.309 | 0.568 | 1.558 | 0.674 | 0.595 | 2.419 | −1.295 | 0.595 |
| 2.359 | −1.266 | 0.568 | 1.473 | 0.783 | 0.595 | 2.408 | −1.321 | 0.595 |
| 2.311 | −0.981 | 0.568 | 1.399 | 0.026 | 0.595 | 2.249 | −0.840 | 0.595 |
| 2.238 | −0.783 | 0.568 | 1.451 | −0.020 | 0.595 | 2.322 | −1.035 | 0.595 |
| 2.406 | −1.337 | 0.568 | 1.517 | 0.730 | 0.595 | 2.275 | −1.132 | 0.595 |
| 2.287 | −0.915 | 0.568 | 1.551 | −0.116 | 0.595 | 2.239 | −1.073 | 0.595 |
| 2.394 | −1.327 | 0.568 | 1.635 | 0.558 | 0.595 | 2.346 | −1.100 | 0.595 |
| 0.371 | 0.684 | 0.595 | 1.690 | −0.271 | 0.595 | 2.392 | −1.322 | 0.595 |
| 0.650 | 0.370 | 0.595 | 1.861 | −0.490 | 0.595 | 2.298 | −0.970 | 0.595 |
| 0.445 | 0.408 | 0.595 | 1.599 | −0.167 | 0.595 | 2.419 | −1.311 | 0.595 |
| 0.667 | 0.971 | 0.595 | 1.800 | 0.253 | 0.595 | 2.200 | −0.710 | 0.595 |
| 0.409 | 0.742 | 0.595 | 1.820 | −0.435 | 0.595 | 2.370 | −1.165 | 0.595 |
| 0.382 | 0.436 | 0.595 | 1.645 | −0.218 | 0.595 | 2.310 | −1.192 | 0.595 |
| 0.730 | 1.001 | 0.595 | 1.671 | 0.499 | 0.595 | 0.464 | 0.444 | 0.622 |
| 0.582 | 0.384 | 0.595 | 1.830 | 0.190 | 0.595 | 0.666 | 0.403 | 0.622 |
| 0.452 | 0.797 | 0.595 | 1.738 | 0.377 | 0.595 | 0.676 | 0.990 | 0.622 |
| 0.337 | 0.487 | 0.595 | 1.705 | 0.438 | 0.595 | 0.347 | 0.650 | 0.622 |
| 0.514 | 0.395 | 0.595 | 1.859 | 0.127 | 0.595 | 0.738 | 1.018 | 0.622 |
| 0.795 | 1.024 | 0.595 | 1.769 | 0.315 | 0.595 | 0.599 | 0.419 | 0.622 |
| 0.500 | 0.847 | 0.595 | 1.734 | −0.325 | 0.595 | 0.508 | 0.871 | 0.622 |
| 0.324 | 0.555 | 0.595 | 1.777 | −0.379 | 0.595 | 0.351 | 0.516 | 0.622 |
| 0.786 | 0.339 | 0.595 | 1.997 | −0.192 | 0.595 | 0.335 | 0.582 | 0.622 |
| 0.552 | 0.893 | 0.595 | 2.049 | −0.321 | 0.595 | 0.532 | 0.432 | 0.622 |
| 0.339 | 0.623 | 0.595 | 2.023 | −0.256 | 0.595 | 0.560 | 0.916 | 0.622 |
| 0.718 | 0.355 | 0.595 | 2.094 | −0.836 | 0.595 | 0.417 | 0.768 | 0.622 |
| 0.608 | 0.935 | 0.595 | 2.125 | −0.515 | 0.595 | 0.378 | 0.711 | 0.622 |
| 0.984 | 0.276 | 0.595 | 1.941 | −0.604 | 0.595 | 0.616 | 0.955 | 0.622 |
| 1.289 | 0.112 | 0.595 | 2.150 | −0.580 | 0.595 | 0.733 | 0.386 | 0.622 |
| 0.460 | 0.821 | 0.622 | 2.117 | −0.884 | 0.622 | 0.385 | 0.738 | 0.649 |
| 0.400 | 0.469 | 0.622 | 2.085 | −0.444 | 0.622 | 0.624 | 0.977 | 0.649 |
| 0.799 | 0.366 | 0.622 | 1.956 | −0.125 | 0.622 | 0.515 | 0.895 | 0.649 |
| 0.864 | 0.344 | 0.622 | 2.110 | −0.508 | 0.622 | 0.356 | 0.677 | 0.649 |
| 1.265 | 0.964 | 0.622 | 1.886 | −0.542 | 0.622 | 0.615 | 0.454 | 0.649 |
| 1.205 | 0.998 | 0.622 | 1.983 | −0.188 | 0.622 | 0.745 | 0.414 | 0.649 |
| 1.008 | 1.056 | 0.622 | 2.153 | −0.942 | 0.622 | 0.549 | 0.468 | 0.649 |
| 1.053 | 0.263 | 0.622 | 1.965 | −0.654 | 0.622 | 0.346 | 0.610 | 0.649 |
| 1.173 | 0.195 | 0.622 | 2.135 | −0.572 | 0.622 | 0.996 | 0.308 | 0.649 |
| 0.928 | 0.320 | 0.622 | 2.009 | −0.252 | 0.622 | 1.170 | 0.203 | 0.649 |
| 1.230 | 0.157 | 0.622 | 2.004 | −0.711 | 0.622 | 1.014 | 1.064 | 0.649 |
| 0.804 | 1.039 | 0.622 | 2.160 | −0.636 | 0.622 | 1.207 | 0.999 | 0.649 |
| 1.142 | 1.025 | 0.622 | 2.034 | −0.316 | 0.622 | 1.265 | 0.964 | 0.649 |
| 0.939 | 1.059 | 0.622 | 2.042 | −0.768 | 0.622 | 1.225 | 0.163 | 0.649 |
| 0.991 | 0.293 | 0.622 | 1.926 | −0.598 | 0.622 | 1.081 | 1.050 | 0.649 |
| 1.114 | 0.230 | 0.622 | 2.060 | −0.380 | 0.622 | 0.809 | 0.391 | 0.649 |
| 0.871 | 1.053 | 0.622 | 1.930 | −0.062 | 0.622 | 1.055 | 0.276 | 0.649 |
| 1.076 | 1.044 | 0.622 | 2.080 | −0.826 | 0.622 | 0.873 | 0.366 | 0.649 |
| 1.285 | 0.116 | 0.622 | 1.902 | 0.002 | 0.622 | 0.878 | 1.066 | 0.649 |
| 1.321 | 0.924 | 0.622 | 2.330 | −1.086 | 0.622 | 0.946 | 1.069 | 0.649 |
| 1.491 | −0.066 | 0.622 | 2.209 | −0.764 | 0.622 | 1.114 | 0.240 | 0.649 |
| 1.586 | −0.165 | 0.622 | 2.296 | −1.177 | 0.622 | 1.145 | 1.028 | 0.649 |
| 1.510 | 0.726 | 0.622 | 2.403 | −1.294 | 0.622 | 1.279 | 0.121 | 0.649 |
| 1.468 | 0.780 | 0.622 | 2.234 | −0.829 | 0.622 | 0.811 | 1.055 | 0.649 |
| 1.551 | 0.670 | 0.622 | 2.365 | −1.296 | 0.622 | 0.935 | 0.338 | 0.649 |
| 1.422 | 0.831 | 0.622 | 2.189 | −1.000 | 0.622 | 1.526 | −0.113 | 0.649 |
| 1.339 | 0.073 | 0.622 | 2.403 | −1.279 | 0.622 | 1.417 | 0.829 | 0.649 |
| 1.539 | −0.115 | 0.622 | 2.392 | −1.305 | 0.622 | 1.503 | 0.723 | 0.649 |
| 1.589 | 0.613 | 0.622 | 2.258 | −0.893 | 0.622 | 1.331 | 0.077 | 0.649 |
| 1.373 | 0.879 | 0.622 | 2.331 | −1.237 | 0.622 | 1.319 | 0.923 | 0.649 |
| 1.391 | 0.029 | 0.622 | 2.225 | −1.059 | 0.622 | 1.431 | −0.016 | 0.649 |
| 1.442 | −0.018 | 0.622 | 2.379 | −1.215 | 0.622 | 1.571 | −0.164 | 0.649 |
| 1.817 | 0.190 | 0.622 | 2.282 | −0.957 | 0.622 | 1.580 | 0.611 | 0.649 |
| 1.661 | 0.496 | 0.622 | 2.377 | −1.306 | 0.622 | 1.479 | −0.064 | 0.649 |
| 1.846 | −0.486 | 0.622 | 2.354 | −1.151 | 0.622 | 1.370 | 0.878 | 0.649 |
| 1.720 | −0.322 | 0.622 | 2.306 | −1.022 | 0.622 | 1.382 | 0.031 | 0.649 |
| 1.846 | 0.127 | 0.622 | 2.185 | −0.700 | 0.622 | 1.462 | 0.777 | 0.649 |

TABLE I-continued

| X | Y | Z' | X | Y | Z' | X | Y | Z' |
|---|---|---|---|---|---|---|---|---|
| 1.677 | −0.269 | 0.622 | 2.261 | −1.118 | 0.622 | 1.542 | 0.668 | 0.649 |
| 1.694 | 0.435 | 0.622 | 0.482 | 0.480 | 0.649 | 1.775 | 0.252 | 0.649 |
| 1.805 | −0.431 | 0.622 | 0.567 | 0.938 | 0.649 | 1.616 | −0.215 | 0.649 |
| 1.875 | 0.065 | 0.622 | 0.680 | 0.435 | 0.649 | 1.682 | 0.434 | 0.649 |
| 1.726 | 0.375 | 0.622 | 0.366 | 0.546 | 0.649 | 1.832 | 0.129 | 0.649 |
| 1.632 | −0.217 | 0.622 | 0.468 | 0.846 | 0.649 | 1.804 | 0.191 | 0.649 |
| 1.757 | 0.313 | 0.622 | 0.746 | 1.036 | 0.649 | 1.650 | 0.494 | 0.649 |
| 1.763 | −0.376 | 0.622 | 0.417 | 0.502 | 0.649 | 1.745 | 0.313 | 0.649 |
| 1.788 | 0.252 | 0.622 | 0.424 | 0.794 | 0.649 | 1.745 | −0.373 | 0.649 |
| 1.626 | 0.555 | 0.622 | 0.683 | 1.010 | 0.649 | 1.615 | 0.553 | 0.649 |
| 1.860 | 0.067 | 0.649 | 0.381 | 0.575 | 0.676 | 1.809 | −0.475 | 0.676 |
| 1.787 | −0.427 | 0.649 | 0.522 | 0.918 | 0.676 | 1.600 | −0.212 | 0.676 |
| 1.660 | −0.267 | 0.649 | 0.690 | 1.029 | 0.676 | 1.818 | 0.132 | 0.676 |
| 1.828 | −0.481 | 0.649 | 0.566 | 0.504 | 0.676 | 1.850 | −0.529 | 0.676 |
| 1.703 | −0.320 | 0.649 | 0.392 | 0.765 | 0.676 | 1.604 | 0.552 | 0.676 |
| 1.868 | −0.536 | 0.649 | 0.431 | 0.819 | 0.676 | 1.643 | −0.263 | 0.676 |
| 1.714 | 0.374 | 0.649 | 0.363 | 0.704 | 0.676 | 1.701 | 0.375 | 0.676 |
| 1.941 | −0.120 | 0.649 | 0.758 | 0.442 | 0.676 | 1.638 | 0.494 | 0.676 |
| 1.986 | −0.703 | 0.649 | 0.435 | 0.536 | 0.676 | 1.685 | −0.316 | 0.676 |
| 2.062 | −0.815 | 0.649 | 0.753 | 1.053 | 0.676 | 1.846 | 0.071 | 0.676 |
| 2.095 | −0.499 | 0.649 | 0.474 | 0.871 | 0.676 | 1.670 | 0.435 | 0.676 |
| 2.169 | −0.689 | 0.649 | 0.695 | 0.466 | 0.676 | 1.873 | 0.009 | 0.676 |
| 2.137 | −0.929 | 0.649 | 0.630 | 0.998 | 0.676 | 1.761 | 0.254 | 0.676 |
| 1.888 | 0.005 | 0.649 | 0.631 | 0.487 | 0.676 | 1.727 | −0.369 | 0.676 |
| 2.070 | −0.436 | 0.649 | 0.881 | 0.387 | 0.676 | 2.152 | −0.677 | 0.676 |
| 2.025 | −0.759 | 0.649 | 1.167 | 0.211 | 0.676 | 2.156 | −0.972 | 0.676 |
| 2.119 | −0.562 | 0.649 | 1.113 | 0.251 | 0.676 | 1.900 | −0.053 | 0.676 |
| 1.947 | −0.647 | 0.649 | 1.263 | 0.965 | 0.676 | 1.968 | −0.693 | 0.676 |
| 2.019 | −0.309 | 0.649 | 0.885 | 1.079 | 0.676 | 2.029 | −0.364 | 0.676 |
| 2.144 | −0.626 | 0.649 | 1.084 | 1.056 | 0.676 | 1.927 | −0.114 | 0.676 |
| 1.915 | −0.058 | 0.649 | 0.941 | 0.356 | 0.676 | 2.007 | −0.748 | 0.676 |
| 1.908 | −0.591 | 0.649 | 1.272 | 0.126 | 0.676 | 2.103 | −0.552 | 0.676 |
| 1.994 | −0.246 | 0.649 | 0.952 | 1.080 | 0.676 | 2.128 | −0.614 | 0.676 |
| 2.100 | −0.872 | 0.649 | 0.999 | 0.323 | 0.676 | 1.953 | −0.177 | 0.676 |
| 2.044 | −0.372 | 0.649 | 1.220 | 0.170 | 0.676 | 2.045 | −0.804 | 0.676 |
| 1.968 | −0.183 | 0.649 | 0.818 | 1.070 | 0.676 | 2.079 | −0.489 | 0.676 |
| 2.242 | −0.880 | 0.649 | 1.207 | 1.001 | 0.676 | 1.978 | −0.239 | 0.676 |
| 2.244 | −1.103 | 0.649 | 0.820 | 0.416 | 0.676 | 2.082 | −0.860 | 0.676 |
| 2.387 | −1.277 | 0.649 | 1.057 | 0.288 | 0.676 | 1.889 | −0.584 | 0.676 |
| 2.376 | −1.287 | 0.649 | 1.147 | 1.032 | 0.676 | 2.004 | −0.301 | 0.676 |
| 2.209 | −1.045 | 0.649 | 1.019 | 1.072 | 0.676 | 2.119 | −0.916 | 0.676 |
| 2.349 | −1.278 | 0.649 | 1.455 | 0.776 | 0.676 | 1.929 | −0.638 | 0.676 |
| 2.387 | −1.262 | 0.649 | 1.322 | 0.081 | 0.676 | 2.054 | −0.426 | 0.676 |
| 2.314 | −1.220 | 0.649 | 1.365 | 0.877 | 0.676 | 2.332 | −1.259 | 0.676 |
| 2.338 | −1.134 | 0.649 | 1.465 | −0.061 | 0.676 | 2.370 | −1.258 | 0.676 |
| 2.218 | −0.816 | 0.649 | 1.533 | 0.667 | 0.676 | 2.224 | −0.866 | 0.676 |
| 2.266 | −0.943 | 0.649 | 1.556 | −0.161 | 0.676 | 2.321 | −1.117 | 0.676 |
| 2.173 | −0.987 | 0.649 | 1.570 | 0.610 | 0.676 | 2.200 | −0.803 | 0.676 |
| 2.280 | −1.161 | 0.649 | 1.316 | 0.923 | 0.676 | 2.272 | −0.992 | 0.676 |
| 2.314 | −1.071 | 0.649 | 1.419 | −0.012 | 0.676 | 2.344 | −1.269 | 0.676 |
| 2.361 | −1.288 | 0.649 | 1.411 | 0.828 | 0.676 | 2.228 | −1.087 | 0.676 |
| 2.193 | −0.753 | 0.649 | 1.371 | 0.035 | 0.676 | 2.345 | −1.180 | 0.676 |
| 2.362 | −1.198 | 0.649 | 1.495 | 0.722 | 0.676 | 2.297 | −1.055 | 0.676 |
| 2.290 | −1.007 | 0.649 | 1.511 | −0.110 | 0.676 | 2.192 | −1.029 | 0.676 |
| 0.499 | 0.517 | 0.676 | 1.790 | 0.193 | 0.676 | 2.359 | −1.268 | 0.676 |
| 0.357 | 0.637 | 0.676 | 1.769 | −0.422 | 0.676 | 2.263 | −1.144 | 0.676 |
| 0.574 | 0.961 | 0.676 | 1.731 | 0.315 | 0.676 | 2.176 | −0.740 | 0.676 |
| 2.248 | −0.929 | 0.676 | 1.496 | −0.107 | 0.703 | 2.328 | −1.162 | 0.703 |
| 2.298 | −1.202 | 0.676 | 1.523 | 0.666 | 0.703 | 2.342 | −1.249 | 0.703 |
| 2.370 | −1.243 | 0.676 | 1.406 | −0.009 | 0.703 | 2.183 | −0.789 | 0.703 |
| 0.454 | 0.572 | 0.703 | 1.312 | 0.086 | 0.703 | 2.175 | −1.013 | 0.703 |
| 0.436 | 0.846 | 0.703 | 1.312 | 0.923 | 0.703 | 2.304 | −1.099 | 0.703 |
| 0.580 | 0.984 | 0.703 | 1.858 | 0.015 | 0.703 | 2.211 | −1.070 | 0.703 |
| 0.371 | 0.731 | 0.703 | 1.626 | −0.259 | 0.703 | 2.255 | −0.975 | 0.703 |
| 0.518 | 0.554 | 0.703 | 1.709 | −0.363 | 0.703 | 2.327 | −1.249 | 0.703 |
| 0.646 | 0.520 | 0.703 | 1.790 | −0.469 | 0.703 | 2.353 | −1.238 | 0.703 |
| 0.480 | 0.896 | 0.703 | 1.750 | −0.416 | 0.703 | 0.401 | 0.819 | 0.730 |
| 0.759 | 1.071 | 0.703 | 1.747 | 0.257 | 0.703 | 0.414 | 0.638 | 0.730 |
| 0.708 | 0.495 | 0.703 | 1.831 | 0.076 | 0.703 | 0.600 | 0.576 | 0.730 |
| 0.769 | 0.468 | 0.703 | 1.803 | 0.136 | 0.703 | 0.584 | 1.007 | 0.730 |
| 0.527 | 0.943 | 0.703 | 1.626 | 0.495 | 0.703 | 0.764 | 1.089 | 0.730 |
| 0.397 | 0.792 | 0.703 | 1.871 | −0.575 | 0.703 | 0.662 | 0.553 | 0.730 |
| 0.636 | 1.020 | 0.703 | 1.657 | 0.436 | 0.703 | 0.780 | 0.495 | 0.730 |
| 0.696 | 1.049 | 0.703 | 1.718 | 0.317 | 0.703 | 0.377 | 0.758 | 0.730 |
| 0.397 | 0.606 | 0.703 | 1.667 | −0.311 | 0.703 | 0.378 | 0.692 | 0.730 |
| 0.583 | 0.541 | 0.703 | 1.831 | −0.522 | 0.703 | 0.440 | 0.872 | 0.730 |
| 0.368 | 0.665 | 0.703 | 1.775 | 0.197 | 0.703 | 0.701 | 1.068 | 0.730 |

TABLE I-continued

| X | Y | Z' | X | Y | Z' | X | Y | Z' |
|---|---|---|---|---|---|---|---|---|
| 0.945 | 0.373 | 0.703 | 1.688 | 0.377 | 0.703 | 0.536 | 0.592 | 0.730 |
| 0.888 | 0.407 | 0.703 | 2.037 | −0.416 | 0.703 | 0.484 | 0.921 | 0.730 |
| 1.001 | 0.337 | 0.703 | 2.159 | −0.726 | 0.703 | 0.472 | 0.608 | 0.730 |
| 1.261 | 0.966 | 0.703 | 2.111 | −0.602 | 0.703 | 0.532 | 0.967 | 0.730 |
| 0.890 | 1.092 | 0.703 | 1.988 | −0.737 | 0.703 | 0.722 | 0.525 | 0.730 |
| 1.087 | 1.062 | 0.703 | 1.987 | −0.292 | 0.703 | 0.641 | 1.041 | 0.730 |
| 1.162 | 0.219 | 0.703 | 2.139 | −0.957 | 0.703 | 0.894 | 1.106 | 0.730 |
| 1.056 | 0.300 | 0.703 | 1.911 | −0.108 | 0.703 | 0.948 | 0.389 | 0.730 |
| 1.022 | 1.080 | 0.703 | 1.937 | −0.169 | 0.703 | 1.147 | 1.041 | 0.730 |
| 0.824 | 1.086 | 0.703 | 1.884 | −0.047 | 0.703 | 1.155 | 0.226 | 0.730 |
| 1.213 | 0.176 | 0.703 | 2.135 | −0.664 | 0.703 | 1.307 | 0.925 | 0.730 |
| 1.110 | 0.260 | 0.703 | 2.062 | −0.478 | 0.703 | 1.054 | 0.310 | 0.730 |
| 1.206 | 1.004 | 0.703 | 2.027 | −0.792 | 0.703 | 1.001 | 0.350 | 0.730 |
| 1.263 | 0.132 | 0.703 | 2.086 | −0.540 | 0.703 | 1.257 | 0.968 | 0.730 |
| 0.957 | 1.091 | 0.703 | 1.949 | −0.683 | 0.703 | 0.828 | 1.101 | 0.730 |
| 0.829 | 0.439 | 0.703 | 2.013 | −0.354 | 0.703 | 1.204 | 1.007 | 0.730 |
| 1.148 | 1.036 | 0.703 | 1.962 | −0.231 | 0.703 | 1.105 | 0.269 | 0.730 |
| 1.360 | 0.877 | 0.703 | 2.064 | −0.846 | 0.703 | 1.087 | 1.069 | 0.730 |
| 1.447 | 0.776 | 0.703 | 1.910 | −0.629 | 0.703 | 0.837 | 0.462 | 0.730 |
| 1.451 | −0.058 | 0.703 | 2.102 | −0.902 | 0.703 | 1.299 | 0.090 | 0.730 |
| 1.559 | 0.610 | 0.703 | 2.246 | −1.126 | 0.703 | 0.893 | 0.426 | 0.730 |
| 1.583 | −0.208 | 0.703 | 2.315 | −1.240 | 0.703 | 1.252 | 0.136 | 0.730 |
| 1.405 | 0.827 | 0.703 | 2.207 | −0.851 | 0.703 | 0.960 | 1.102 | 0.730 |
| 1.486 | 0.722 | 0.703 | 2.353 | −1.223 | 0.703 | 1.204 | 0.182 | 0.730 |
| 1.593 | 0.553 | 0.703 | 2.279 | −1.037 | 0.703 | 1.025 | 1.089 | 0.730 |
| 1.359 | 0.039 | 0.703 | 2.281 | −1.183 | 0.703 | 1.390 | −0.006 | 0.730 |
| 1.540 | −0.157 | 0.703 | 2.231 | −0.913 | 0.703 | 1.580 | 0.554 | 0.730 |
| 1.547 | 0.611 | 0.730 | 2.046 | −0.832 | 0.730 | 0.844 | 0.483 | 0.757 |
| 1.476 | 0.722 | 0.730 | 2.298 | −1.220 | 0.730 | 1.146 | 1.046 | 0.757 |
| 1.435 | −0.054 | 0.730 | 2.286 | −1.080 | 0.730 | 1.283 | 0.093 | 0.757 |
| 1.564 | −0.204 | 0.730 | 2.193 | −1.052 | 0.730 | 0.999 | 0.363 | 0.757 |
| 1.437 | 0.776 | 0.730 | 2.335 | −1.218 | 0.730 | 1.328 | 0.046 | 0.757 |
| 1.522 | −0.154 | 0.730 | 2.191 | −0.834 | 0.730 | 1.345 | 0.880 | 0.757 |
| 1.353 | 0.878 | 0.730 | 2.311 | −1.142 | 0.730 | 1.458 | −0.101 | 0.757 |
| 1.512 | 0.667 | 0.730 | 2.335 | −1.203 | 0.730 | 1.709 | −0.402 | 0.757 |
| 1.345 | 0.043 | 0.730 | 2.309 | −1.229 | 0.730 | 1.749 | −0.454 | 0.757 |
| 1.397 | 0.828 | 0.730 | 2.228 | −1.107 | 0.730 | 1.825 | 0.029 | 0.757 |
| 1.479 | −0.104 | 0.730 | 2.324 | −1.229 | 0.730 | 1.870 | −0.608 | 0.757 |
| 1.732 | 0.261 | 0.730 | 2.239 | −0.957 | 0.730 | 1.988 | −0.764 | 0.757 |
| 1.606 | −0.255 | 0.730 | 2.215 | −0.896 | 0.730 | 2.102 | −0.924 | 0.757 |
| 1.771 | −0.461 | 0.730 | 2.263 | −1.164 | 0.730 | 1.928 | −0.211 | 0.757 |
| 1.811 | −0.514 | 0.730 | 2.263 | −1.019 | 0.730 | 1.910 | −0.660 | 0.757 |
| 1.868 | −0.039 | 0.730 | 0.768 | 1.108 | 0.757 | 2.027 | −0.453 | 0.757 |
| 1.842 | 0.021 | 0.730 | 0.489 | 0.947 | 0.757 | 2.003 | −0.392 | 0.757 |
| 1.788 | 0.142 | 0.730 | 0.490 | 0.644 | 0.757 | 2.197 | −0.878 | 0.757 |
| 1.760 | 0.202 | 0.730 | 0.790 | 0.519 | 0.757 | 2.173 | −0.817 | 0.757 |
| 1.851 | −0.566 | 0.730 | 0.444 | 0.899 | 0.757 | 1.543 | −0.200 | 0.757 |
| 1.613 | 0.497 | 0.730 | 0.431 | 0.671 | 0.757 | 2.065 | −0.870 | 0.757 |
| 1.703 | 0.321 | 0.730 | 0.705 | 1.089 | 0.757 | 2.317 | −1.197 | 0.757 |
| 1.648 | −0.306 | 0.730 | 0.734 | 0.553 | 0.757 | 1.427 | 0.778 | 0.757 |
| 1.644 | 0.439 | 0.730 | 1.087 | 1.076 | 0.757 | 2.210 | −1.088 | 0.757 |
| 1.689 | −0.357 | 0.730 | 0.948 | 0.404 | 0.757 | 2.306 | −1.207 | 0.757 |
| 1.815 | 0.081 | 0.730 | 0.897 | 0.445 | 0.757 | 1.953 | −0.272 | 0.757 |
| 1.674 | 0.380 | 0.730 | 1.048 | 0.320 | 0.757 | 2.279 | −1.198 | 0.757 |
| 1.730 | −0.409 | 0.730 | 1.192 | 0.187 | 0.757 | 1.659 | 0.384 | 0.757 |
| 2.121 | −0.941 | 0.730 | 1.026 | 1.099 | 0.757 | 1.629 | 0.442 | 0.757 |
| 2.084 | −0.887 | 0.730 | 1.300 | 0.927 | 0.757 | 1.465 | 0.724 | 0.757 |
| 2.045 | −0.466 | 0.730 | 1.201 | 1.011 | 0.757 | 2.124 | −0.696 | 0.757 |
| 1.891 | −0.619 | 0.730 | 1.097 | 0.277 | 0.757 | 2.268 | −1.060 | 0.757 |
| 2.157 | −0.996 | 0.730 | 0.645 | 1.063 | 0.757 | 1.372 | −0.003 | 0.757 |
| 1.930 | −0.672 | 0.730 | 0.676 | 0.584 | 0.757 | 2.100 | −0.635 | 0.757 |
| 1.894 | −0.100 | 0.730 | 0.962 | 1.114 | 0.757 | 1.501 | −0.150 | 0.757 |
| 2.069 | −0.528 | 0.730 | 1.252 | 0.971 | 0.757 | 2.174 | −1.033 | 0.757 |
| 1.995 | −0.344 | 0.730 | 0.390 | 0.721 | 0.757 | 2.291 | −1.208 | 0.757 |
| 1.969 | −0.725 | 0.730 | 0.384 | 0.785 | 0.757 | 1.534 | 0.614 | 0.757 |
| 1.920 | −0.161 | 0.730 | 0.589 | 1.030 | 0.757 | 2.245 | −1.143 | 0.757 |
| 2.094 | −0.589 | 0.730 | 0.616 | 0.610 | 0.757 | 1.851 | −0.031 | 0.757 |
| 2.020 | −0.405 | 0.730 | 0.898 | 1.120 | 0.757 | 1.772 | 0.148 | 0.757 |
| 1.970 | −0.283 | 0.730 | 1.145 | 0.232 | 0.757 | 1.744 | 0.208 | 0.757 |
| 2.008 | −0.778 | 0.730 | 1.238 | 0.140 | 0.757 | 2.292 | −1.121 | 0.757 |
| 1.945 | −0.222 | 0.730 | 0.406 | 0.846 | 0.757 | 2.149 | −0.756 | 0.757 |
| 2.118 | −0.650 | 0.730 | 0.537 | 0.991 | 0.757 | 1.415 | −0.051 | 0.757 |
| 2.143 | −0.712 | 0.730 | 0.554 | 0.629 | 0.757 | 1.626 | −0.301 | 0.757 |
| 2.167 | −0.773 | 0.730 | 0.832 | 1.118 | 0.757 | 2.317 | −1.182 | 0.757 |
| 2.139 | −0.978 | 0.757 | 1.293 | 0.931 | 0.784 | 1.967 | −0.749 | 0.784 |
| 1.978 | −0.332 | 0.757 | 1.246 | 0.975 | 0.784 | 2.154 | −0.798 | 0.784 |
| 1.877 | −0.091 | 0.757 | 0.995 | 0.375 | 0.784 | 2.273 | −1.099 | 0.784 |

TABLE I-continued

| X | Y | Z' | X | Y | Z' | X | Y | Z' |
|---|---|---|---|---|---|---|---|---|
| 1.599 | 0.500 | 0.757 | 1.027 | 1.109 | 0.784 | 2.178 | −0.858 | 0.784 |
| 1.830 | −0.556 | 0.757 | 0.964 | 1.126 | 0.784 | 2.226 | −1.121 | 0.784 |
| 1.798 | 0.089 | 0.757 | 1.223 | 0.145 | 0.784 | 1.910 | −0.199 | 0.784 |
| 1.716 | 0.267 | 0.757 | 0.899 | 0.461 | 0.784 | 2.155 | −1.012 | 0.784 |
| 2.221 | −0.939 | 0.757 | 1.310 | 0.050 | 0.784 | 2.044 | −0.853 | 0.784 |
| 2.052 | −0.514 | 0.757 | 1.143 | 1.053 | 0.784 | 1.984 | −0.378 | 0.784 |
| 1.585 | −0.250 | 0.757 | 1.086 | 1.084 | 0.784 | 1.928 | −0.698 | 0.784 |
| 1.668 | −0.351 | 0.757 | 0.947 | 0.419 | 0.784 | 2.082 | −0.618 | 0.784 |
| 2.027 | −0.817 | 0.757 | 1.488 | 0.673 | 0.784 | 2.297 | −1.159 | 0.784 |
| 1.387 | 0.830 | 0.757 | 1.479 | −0.146 | 0.784 | 2.225 | −0.979 | 0.784 |
| 1.790 | −0.505 | 0.757 | 1.378 | 0.833 | 0.784 | 2.006 | −0.801 | 0.784 |
| 1.903 | −0.151 | 0.757 | 1.521 | −0.195 | 0.784 | 2.009 | −0.438 | 0.784 |
| 1.688 | 0.326 | 0.757 | 1.416 | 0.781 | 0.784 | 1.935 | −0.259 | 0.784 |
| 1.949 | −0.712 | 0.757 | 1.521 | 0.618 | 0.784 | 2.260 | −1.175 | 0.784 |
| 1.500 | 0.670 | 0.757 | 1.395 | −0.048 | 0.784 | 2.082 | −0.906 | 0.784 |
| 1.567 | 0.557 | 0.757 | 1.553 | 0.562 | 0.784 | 2.130 | −0.738 | 0.784 |
| 2.076 | −0.574 | 0.757 | 1.563 | −0.245 | 0.784 | 2.106 | −0.678 | 0.784 |
| 2.244 | −0.999 | 0.757 | 1.353 | 0.001 | 0.784 | 2.272 | −1.185 | 0.784 |
| 0.744 | 0.578 | 0.784 | 1.337 | 0.883 | 0.784 | 2.033 | −0.498 | 0.784 |
| 0.412 | 0.871 | 0.784 | 1.584 | 0.505 | 0.784 | 2.119 | −0.959 | 0.784 |
| 0.448 | 0.925 | 0.784 | 1.437 | −0.097 | 0.784 | 2.191 | −1.066 | 0.784 |
| 0.540 | 1.015 | 0.784 | 1.453 | 0.728 | 0.784 | 2.202 | −0.918 | 0.784 |
| 0.570 | 0.662 | 0.784 | 1.755 | 0.157 | 0.784 | 2.287 | −1.184 | 0.784 |
| 0.508 | 0.678 | 0.784 | 1.645 | −0.344 | 0.784 | 2.057 | −0.558 | 0.784 |
| 0.403 | 0.747 | 0.784 | 1.808 | −0.545 | 0.784 | 0.453 | 0.948 | 0.811 |
| 0.709 | 1.109 | 0.784 | 1.686 | −0.394 | 0.784 | 0.700 | 0.636 | 0.811 |
| 0.797 | 0.541 | 0.784 | 1.782 | 0.098 | 0.784 | 0.775 | 1.143 | 0.811 |
| 0.631 | 0.641 | 0.784 | 1.644 | 0.390 | 0.784 | 0.401 | 0.834 | 0.811 |
| 0.492 | 0.972 | 0.784 | 1.727 | −0.445 | 0.784 | 0.645 | 0.668 | 0.811 |
| 0.649 | 1.085 | 0.784 | 1.767 | −0.495 | 0.784 | 0.544 | 1.038 | 0.811 |
| 0.772 | 1.125 | 0.784 | 1.808 | 0.039 | 0.784 | 0.586 | 0.692 | 0.811 |
| 0.448 | 0.702 | 0.784 | 1.672 | 0.332 | 0.784 | 0.416 | 0.773 | 0.811 |
| 0.593 | 1.053 | 0.784 | 1.614 | 0.448 | 0.784 | 0.596 | 1.075 | 0.811 |
| 0.392 | 0.810 | 0.784 | 1.848 | −0.596 | 0.784 | 0.524 | 0.709 | 0.811 |
| 0.689 | 0.611 | 0.784 | 1.834 | −0.021 | 0.784 | 0.464 | 0.731 | 0.811 |
| 1.042 | 0.330 | 0.784 | 1.700 | 0.274 | 0.784 | 0.653 | 1.106 | 0.811 |
| 0.849 | 0.502 | 0.784 | 1.604 | −0.294 | 0.784 | 0.753 | 0.600 | 0.811 |
| 0.900 | 1.134 | 0.784 | 1.860 | −0.080 | 0.784 | 0.497 | 0.995 | 0.811 |
| 1.088 | 0.285 | 0.784 | 1.728 | 0.215 | 0.784 | 0.712 | 1.128 | 0.811 |
| 1.196 | 1.016 | 0.784 | 2.298 | −1.174 | 0.784 | 0.418 | 0.895 | 0.811 |
| 1.134 | 0.239 | 0.784 | 2.249 | −1.039 | 0.784 | 1.027 | 1.119 | 0.811 |
| 0.836 | 1.134 | 0.784 | 1.960 | −0.319 | 0.784 | 1.210 | 0.153 | 0.811 |
| 1.179 | 0.193 | 0.784 | 1.885 | −0.140 | 0.784 | 1.240 | 0.980 | 0.811 |
| 1.267 | 0.098 | 0.784 | 1.888 | −0.647 | 0.784 | 1.036 | 0.341 | 0.811 |
| 1.085 | 1.093 | 0.811 | 1.827 | −0.583 | 0.811 | 0.656 | 1.127 | 0.838 |
| 1.124 | 0.248 | 0.811 | 1.817 | −0.010 | 0.811 | 0.657 | 0.691 | 0.838 |
| 0.838 | 1.150 | 0.811 | 1.867 | −0.127 | 0.811 | 1.187 | 1.028 | 0.838 |
| 1.167 | 0.200 | 0.811 | 2.099 | −0.939 | 0.811 | 1.032 | 0.353 | 0.838 |
| 0.992 | 0.387 | 0.811 | 2.253 | −1.162 | 0.811 | 0.966 | 1.149 | 0.838 |
| 0.853 | 0.520 | 0.811 | 2.230 | −1.017 | 0.811 | 0.902 | 0.492 | 0.838 |
| 1.140 | 1.060 | 0.811 | 2.171 | −1.045 | 0.811 | 1.137 | 1.067 | 0.838 |
| 0.947 | 0.433 | 0.811 | 2.024 | −0.835 | 0.811 | 1.281 | 0.065 | 0.838 |
| 0.902 | 1.148 | 0.811 | 1.947 | −0.733 | 0.811 | 0.841 | 1.166 | 0.838 |
| 0.804 | 0.561 | 0.811 | 2.268 | −1.161 | 0.811 | 0.989 | 0.400 | 0.838 |
| 1.192 | 1.022 | 0.811 | 2.206 | −0.957 | 0.811 | 1.083 | 1.101 | 0.838 |
| 0.965 | 1.137 | 0.811 | 2.182 | −0.898 | 0.811 | 1.240 | 0.114 | 0.838 |
| 1.294 | 0.056 | 0.811 | 2.241 | −1.152 | 0.811 | 1.074 | 0.306 | 0.838 |
| 1.080 | 0.295 | 0.811 | 1.990 | −0.423 | 0.811 | 1.026 | 1.129 | 0.838 |
| 1.285 | 0.935 | 0.811 | 1.986 | −0.784 | 0.811 | 0.857 | 0.536 | 0.838 |
| 1.252 | 0.104 | 0.811 | 2.136 | −0.991 | 0.811 | 0.946 | 0.446 | 0.838 |
| 0.901 | 0.477 | 0.811 | 2.279 | −1.150 | 0.811 | 1.116 | 0.258 | 0.838 |
| 1.418 | −0.090 | 0.811 | 1.942 | −0.304 | 0.811 | 1.158 | 0.210 | 0.838 |
| 1.539 | 0.567 | 0.811 | 1.907 | −0.683 | 0.811 | 0.810 | 0.579 | 0.838 |
| 1.441 | 0.732 | 0.811 | 2.087 | −0.660 | 0.811 | 1.278 | 0.940 | 0.838 |
| 1.508 | 0.623 | 0.811 | 2.062 | −0.887 | 0.811 | 0.904 | 1.162 | 0.838 |
| 1.501 | −0.188 | 0.811 | 2.254 | −1.076 | 0.811 | 1.234 | 0.986 | 0.838 |
| 1.335 | 0.007 | 0.811 | 2.159 | −0.838 | 0.811 | 1.199 | 0.162 | 0.838 |
| 1.368 | 0.837 | 0.811 | 1.892 | −0.186 | 0.811 | 1.322 | 0.016 | 0.838 |
| 1.460 | −0.139 | 0.811 | 2.039 | −0.541 | 0.811 | 1.444 | −0.130 | 0.838 |
| 1.542 | −0.237 | 0.811 | 1.917 | −0.245 | 0.811 | 1.362 | −0.032 | 0.838 |
| 1.328 | 0.887 | 0.811 | 2.206 | −1.098 | 0.811 | 1.556 | 0.517 | 0.838 |
| 1.377 | −0.041 | 0.811 | 1.966 | −0.364 | 0.811 | 1.565 | −0.276 | 0.838 |
| 1.583 | −0.286 | 0.811 | 2.063 | −0.601 | 0.811 | 1.484 | −0.178 | 0.838 |
| 1.405 | 0.785 | 0.811 | 2.278 | −1.135 | 0.811 | 1.403 | −0.081 | 0.838 |
| 1.570 | 0.511 | 0.811 | 2.015 | −0.482 | 0.811 | 1.395 | 0.790 | 0.838 |
| 1.475 | 0.678 | 0.811 | 2.135 | −0.779 | 0.811 | 1.526 | 0.573 | 0.838 |
| 1.657 | 0.340 | 0.811 | 2.111 | −0.719 | 0.811 | 1.463 | 0.683 | 0.838 |

TABLE I-continued

| X | Y | Z' | X | Y | Z' | X | Y | Z' |
|---|---|---|---|---|---|---|---|---|
| 1.665 | −0.385 | 0.811 | 0.549 | 1.060 | 0.838 | 1.358 | 0.842 | 0.838 |
| 1.791 | 0.049 | 0.811 | 0.716 | 1.148 | 0.838 | 1.495 | 0.628 | 0.838 |
| 1.712 | 0.224 | 0.811 | 0.480 | 0.759 | 0.838 | 1.319 | 0.892 | 0.838 |
| 1.684 | 0.282 | 0.811 | 0.710 | 0.657 | 0.838 | 1.525 | −0.227 | 0.838 |
| 1.746 | −0.484 | 0.811 | 0.600 | 1.097 | 0.838 | 1.585 | 0.461 | 0.838 |
| 1.738 | 0.166 | 0.811 | 0.599 | 0.718 | 0.838 | 1.430 | 0.737 | 0.838 |
| 1.867 | −0.633 | 0.811 | 0.761 | 0.619 | 0.838 | 1.614 | 0.404 | 0.838 |
| 1.842 | −0.068 | 0.811 | 0.502 | 1.018 | 0.838 | 1.875 | −0.173 | 0.838 |
| 1.600 | 0.454 | 0.811 | 0.425 | 0.918 | 0.838 | 1.774 | 0.060 | 0.838 |
| 1.787 | −0.533 | 0.811 | 0.459 | 0.971 | 0.838 | 1.722 | 0.175 | 0.838 |
| 1.628 | 0.397 | 0.811 | 0.410 | 0.857 | 0.838 | 1.768 | −0.520 | 0.838 |
| 1.705 | −0.434 | 0.811 | 0.430 | 0.798 | 0.838 | 1.669 | 0.290 | 0.838 |
| 1.765 | 0.107 | 0.811 | 0.539 | 0.738 | 0.838 | 1.606 | −0.324 | 0.838 |
| 1.624 | −0.336 | 0.811 | 0.778 | 1.162 | 0.838 | 1.727 | −0.471 | 0.838 |
| 1.696 | 0.233 | 0.838 | 0.720 | 1.167 | 0.865 | 1.809 | −0.045 | 0.865 |
| 1.848 | −0.618 | 0.838 | 0.781 | 1.178 | 0.865 | 1.707 | 0.185 | 0.865 |
| 1.642 | 0.348 | 0.838 | 0.465 | 0.993 | 0.865 | 1.752 | −0.505 | 0.865 |
| 1.850 | −0.115 | 0.838 | 0.506 | 1.041 | 0.865 | 1.858 | −0.161 | 0.865 |
| 1.800 | 0.002 | 0.838 | 0.554 | 0.764 | 0.865 | 1.883 | −0.219 | 0.865 |
| 1.646 | −0.373 | 0.838 | 0.421 | 0.879 | 0.865 | 1.759 | 0.070 | 0.865 |
| 1.825 | −0.057 | 0.838 | 0.432 | 0.940 | 0.865 | 1.681 | 0.242 | 0.865 |
| 1.687 | −0.422 | 0.838 | 0.495 | 0.786 | 0.865 | 1.792 | −0.553 | 0.865 |
| 1.749 | 0.118 | 0.838 | 1.191 | 0.173 | 0.865 | 1.832 | −0.602 | 0.865 |
| 1.808 | −0.568 | 0.838 | 0.904 | 0.505 | 0.865 | 1.631 | −0.360 | 0.865 |
| 1.996 | −0.466 | 0.838 | 1.070 | 0.317 | 0.865 | 1.834 | −0.103 | 0.865 |
| 2.005 | −0.817 | 0.838 | 0.860 | 0.550 | 0.865 | 1.784 | 0.013 | 0.865 |
| 2.043 | −0.868 | 0.838 | 0.815 | 0.594 | 0.865 | 1.628 | 0.355 | 0.865 |
| 2.260 | −1.127 | 0.838 | 0.968 | 1.160 | 0.865 | 1.871 | −0.651 | 0.865 |
| 2.117 | −0.971 | 0.838 | 0.844 | 1.181 | 0.865 | 1.733 | 0.127 | 0.865 |
| 2.222 | −1.130 | 0.838 | 1.111 | 0.269 | 0.865 | 1.600 | 0.412 | 0.865 |
| 2.020 | −0.525 | 0.838 | 1.151 | 0.221 | 0.865 | 1.712 | −0.457 | 0.865 |
| 2.259 | −1.112 | 0.838 | 1.271 | 0.945 | 0.865 | 1.655 | 0.299 | 0.865 |
| 1.928 | −0.717 | 0.838 | 0.907 | 1.175 | 0.865 | 2.231 | −1.116 | 0.865 |
| 2.187 | −0.936 | 0.838 | 1.231 | 0.124 | 0.865 | 2.050 | −0.625 | 0.865 |
| 1.948 | −0.349 | 0.838 | 1.082 | 1.109 | 0.865 | 2.134 | −1.003 | 0.865 |
| 2.234 | −1.139 | 0.838 | 1.271 | 0.076 | 0.865 | 1.949 | −0.749 | 0.865 |
| 2.116 | −0.760 | 0.838 | 1.183 | 1.034 | 0.865 | 2.241 | −1.090 | 0.865 |
| 2.164 | −0.877 | 0.838 | 1.229 | 0.991 | 0.865 | 2.215 | −1.117 | 0.865 |
| 2.211 | −0.995 | 0.838 | 0.946 | 0.459 | 0.865 | 2.145 | −0.858 | 0.865 |
| 2.080 | −0.919 | 0.838 | 1.026 | 1.138 | 0.865 | 2.169 | −1.055 | 0.865 |
| 2.235 | −1.054 | 0.838 | 1.311 | 0.027 | 0.865 | 1.987 | −0.799 | 0.865 |
| 1.888 | −0.667 | 0.838 | 1.134 | 1.074 | 0.865 | 2.098 | −0.741 | 0.865 |
| 2.068 | −0.642 | 0.838 | 0.988 | 0.412 | 0.865 | 2.192 | −0.974 | 0.865 |
| 2.249 | −1.138 | 0.838 | 1.311 | 0.897 | 0.865 | 2.074 | −0.683 | 0.865 |
| 2.140 | −0.818 | 0.838 | 1.029 | 0.365 | 0.865 | 2.122 | −0.799 | 0.865 |
| 1.966 | −0.767 | 0.838 | 1.349 | 0.847 | 0.865 | 2.026 | −0.567 | 0.865 |
| 1.924 | −0.290 | 0.838 | 1.431 | −0.118 | 0.865 | 2.203 | −1.108 | 0.865 |
| 2.152 | −1.023 | 0.838 | 1.391 | −0.070 | 0.865 | 2.025 | −0.849 | 0.865 |
| 1.900 | −0.232 | 0.838 | 1.543 | 0.524 | 0.865 | 1.979 | −0.451 | 0.865 |
| 2.188 | −1.076 | 0.838 | 1.572 | 0.468 | 0.865 | 2.169 | −0.916 | 0.865 |
| 1.972 | −0.408 | 0.838 | 1.452 | 0.689 | 0.865 | 1.907 | −0.277 | 0.865 |
| 2.092 | −0.701 | 0.838 | 1.591 | −0.312 | 0.865 | 1.955 | −0.393 | 0.865 |
| 2.044 | −0.584 | 0.838 | 1.551 | −0.263 | 0.865 | 2.216 | −1.032 | 0.865 |
| 0.613 | 0.742 | 0.865 | 1.511 | −0.215 | 0.865 | 2.062 | −0.900 | 0.865 |
| 0.553 | 1.083 | 0.865 | 1.351 | −0.021 | 0.865 | 2.242 | −1.105 | 0.865 |
| 0.668 | 0.712 | 0.865 | 1.385 | 0.795 | 0.865 | 1.931 | −0.335 | 0.865 |
| 0.444 | 0.822 | 0.865 | 1.471 | −0.167 | 0.865 | 2.099 | −0.951 | 0.865 |
| 0.660 | 1.147 | 0.865 | 1.483 | 0.634 | 0.865 | 2.002 | −0.509 | 0.865 |
| 0.604 | 1.118 | 0.865 | 1.514 | 0.579 | 0.865 | 1.910 | −0.700 | 0.865 |
| 0.768 | 0.636 | 0.865 | 1.419 | 0.742 | 0.865 | 0.471 | 1.014 | 0.892 |
| 0.720 | 0.676 | 0.865 | 1.672 | −0.408 | 0.865 | 0.440 | 0.961 | 0.892 |
| 0.727 | 0.693 | 0.892 | 1.816 | −0.586 | 0.892 | 2.080 | −0.723 | 0.892 |
| 0.774 | 0.652 | 0.892 | 1.768 | 0.024 | 0.892 | 2.198 | −1.011 | 0.892 |
| 0.511 | 1.062 | 0.892 | 1.587 | 0.420 | 0.892 | 2.151 | −1.034 | 0.892 |
| 0.510 | 0.812 | 0.892 | 1.539 | −0.249 | 0.892 | 1.933 | −0.732 | 0.892 |
| 0.664 | 1.167 | 0.892 | 1.460 | −0.153 | 0.892 | 0.448 | 0.981 | 0.919 |
| 0.557 | 1.104 | 0.892 | 1.667 | 0.251 | 0.892 | 0.562 | 1.125 | 0.919 |
| 0.458 | 0.845 | 0.892 | 1.471 | 0.641 | 0.892 | 0.524 | 0.836 | 0.919 |
| 0.784 | 1.196 | 0.892 | 1.658 | −0.393 | 0.892 | 0.472 | 0.868 | 0.919 |
| 0.430 | 0.900 | 0.892 | 1.743 | 0.081 | 0.892 | 0.441 | 0.920 | 0.919 |
| 0.678 | 0.731 | 0.892 | 1.866 | −0.205 | 0.892 | 0.686 | 0.747 | 0.919 |
| 0.568 | 0.789 | 0.892 | 1.614 | 0.364 | 0.892 | 0.612 | 1.160 | 0.919 |
| 0.723 | 1.186 | 0.892 | 1.855 | −0.634 | 0.892 | 0.478 | 1.035 | 0.919 |
| 0.608 | 1.139 | 0.892 | 1.375 | 0.801 | 0.892 | 0.727 | 1.205 | 0.919 |
| 0.624 | 0.763 | 0.892 | 1.693 | 0.194 | 0.892 | 0.733 | 0.708 | 0.919 |
| 1.066 | 0.329 | 0.892 | 1.698 | −0.441 | 0.892 | 0.517 | 1.082 | 0.919 |
| 0.905 | 0.519 | 0.892 | 1.618 | −0.345 | 0.892 | 0.788 | 1.213 | 0.919 |

TABLE I-continued

| X | Y | Z' | X | Y | Z' | X | Y | Z' |
|---|---|---|---|---|---|---|---|---|
| 1.106 | 0.281 | 0.892 | 1.408 | 0.748 | 0.892 | 0.779 | 0.666 | 0.919 |
| 0.946 | 0.472 | 0.892 | 1.842 | −0.148 | 0.892 | 0.581 | 0.811 | 0.919 |
| 1.080 | 1.117 | 0.892 | 1.640 | 0.308 | 0.892 | 0.668 | 1.187 | 0.919 |
| 0.847 | 1.196 | 0.892 | 1.342 | −0.009 | 0.892 | 0.635 | 0.782 | 0.919 |
| 1.131 | 1.081 | 0.892 | 1.718 | 0.138 | 0.892 | 0.946 | 0.485 | 0.919 |
| 0.987 | 0.425 | 0.892 | 1.499 | −0.201 | 0.892 | 0.849 | 1.211 | 0.919 |
| 1.263 | 0.088 | 0.892 | 1.501 | 0.586 | 0.892 | 1.025 | 1.156 | 0.919 |
| 1.224 | 0.136 | 0.892 | 1.420 | −0.105 | 0.892 | 0.864 | 0.577 | 0.919 |
| 0.908 | 1.188 | 0.892 | 1.938 | −0.378 | 0.892 | 1.141 | 0.246 | 0.919 |
| 1.223 | 0.997 | 0.892 | 2.056 | −0.666 | 0.892 | 1.216 | 1.002 | 0.919 |
| 1.264 | 0.951 | 0.892 | 2.174 | −0.954 | 0.892 | 1.173 | 1.046 | 0.919 |
| 1.303 | 0.902 | 0.892 | 1.971 | −0.781 | 0.892 | 0.910 | 1.201 | 0.919 |
| 0.968 | 1.171 | 0.892 | 2.224 | −1.084 | 0.892 | 1.295 | 0.053 | 0.919 |
| 0.819 | 0.609 | 0.892 | 2.008 | −0.831 | 0.892 | 1.024 | 0.390 | 0.919 |
| 1.302 | 0.040 | 0.892 | 1.914 | −0.320 | 0.892 | 1.218 | 0.149 | 0.919 |
| 0.862 | 0.564 | 0.892 | 2.032 | −0.608 | 0.892 | 1.257 | 0.101 | 0.919 |
| 1.185 | 0.185 | 0.892 | 1.894 | −0.683 | 0.892 | 1.257 | 0.956 | 0.919 |
| 1.145 | 0.233 | 0.892 | 2.213 | −1.095 | 0.892 | 0.822 | 0.622 | 0.919 |
| 1.027 | 0.377 | 0.892 | 1.890 | −0.263 | 0.892 | 1.179 | 0.198 | 0.919 |
| 1.178 | 1.041 | 0.892 | 2.009 | −0.551 | 0.892 | 1.127 | 1.087 | 0.919 |
| 1.026 | 1.147 | 0.892 | 2.127 | −0.839 | 0.892 | 1.295 | 0.907 | 0.919 |
| 1.737 | −0.489 | 0.892 | 2.150 | −0.896 | 0.892 | 0.905 | 0.531 | 0.919 |
| 1.818 | −0.091 | 0.892 | 2.081 | −0.931 | 0.892 | 1.063 | 0.342 | 0.919 |
| 1.381 | −0.057 | 0.892 | 2.197 | −1.096 | 0.892 | 0.985 | 0.437 | 0.919 |
| 1.340 | 0.852 | 0.892 | 2.185 | −1.087 | 0.892 | 0.969 | 1.182 | 0.919 |
| 1.777 | −0.537 | 0.892 | 1.985 | −0.493 | 0.892 | 1.102 | 0.294 | 0.919 |
| 1.579 | −0.297 | 0.892 | 2.103 | −0.781 | 0.892 | 1.078 | 1.124 | 0.919 |
| 1.793 | −0.033 | 0.892 | 2.223 | −1.068 | 0.892 | 1.430 | 0.700 | 0.919 |
| 1.559 | 0.476 | 0.892 | 2.045 | −0.881 | 0.892 | 1.529 | −0.234 | 0.919 |
| 1.440 | 0.695 | 0.892 | 2.117 | −0.983 | 0.892 | 1.398 | 0.754 | 0.919 |
| 1.531 | 0.531 | 0.892 | 1.961 | −0.435 | 0.892 | 1.568 | −0.282 | 0.919 |
| 1.331 | 0.857 | 0.919 | 2.086 | −0.762 | 0.919 | 1.123 | 1.094 | 0.946 |
| 1.450 | −0.139 | 0.919 | 2.015 | −0.591 | 0.919 | 0.852 | 1.226 | 0.946 |
| 1.518 | 0.538 | 0.919 | 2.167 | −1.065 | 0.919 | 1.587 | 0.381 | 0.946 |
| 1.460 | 0.647 | 0.919 | 2.205 | −1.047 | 0.919 | 1.404 | −0.076 | 0.946 |
| 1.412 | −0.091 | 0.919 | 1.944 | −0.420 | 0.919 | 1.365 | −0.028 | 0.946 |
| 1.334 | 0.005 | 0.919 | 2.109 | −0.819 | 0.919 | 1.322 | 0.863 | 0.946 |
| 1.365 | 0.806 | 0.919 | 2.195 | −1.073 | 0.919 | 1.388 | 0.760 | 0.946 |
| 1.490 | 0.593 | 0.919 | 2.028 | −0.862 | 0.919 | 1.596 | −0.313 | 0.946 |
| 1.574 | 0.428 | 0.919 | 2.132 | −0.877 | 0.919 | 1.356 | 0.812 | 0.946 |
| 1.546 | 0.483 | 0.919 | 1.921 | −0.363 | 0.919 | 1.558 | −0.266 | 0.946 |
| 1.373 | −0.043 | 0.919 | 0.566 | 1.146 | 0.946 | 1.442 | −0.123 | 0.946 |
| 1.489 | −0.187 | 0.919 | 0.456 | 1.001 | 0.946 | 1.534 | 0.491 | 0.946 |
| 1.826 | −0.135 | 0.919 | 0.644 | 0.800 | 0.946 | 1.481 | −0.171 | 0.946 |
| 1.685 | −0.425 | 0.919 | 0.522 | 1.103 | 0.946 | 1.419 | 0.707 | 0.946 |
| 1.753 | 0.035 | 0.919 | 0.616 | 1.181 | 0.946 | 1.561 | 0.436 | 0.946 |
| 1.646 | −0.378 | 0.919 | 0.592 | 0.832 | 0.946 | 1.478 | 0.600 | 0.946 |
| 1.653 | 0.260 | 0.919 | 0.671 | 1.207 | 0.946 | 1.519 | −0.218 | 0.946 |
| 1.873 | −0.249 | 0.919 | 0.782 | 0.680 | 0.946 | 1.506 | 0.546 | 0.946 |
| 1.627 | 0.316 | 0.919 | 0.738 | 0.723 | 0.946 | 1.327 | 0.020 | 0.946 |
| 1.678 | 0.204 | 0.919 | 0.730 | 1.224 | 0.946 | 1.449 | 0.654 | 0.946 |
| 1.841 | −0.617 | 0.919 | 0.484 | 1.055 | 0.946 | 1.786 | −0.066 | 0.946 |
| 1.607 | −0.330 | 0.919 | 0.537 | 0.859 | 0.946 | 1.635 | −0.361 | 0.946 |
| 1.802 | −0.569 | 0.919 | 0.451 | 0.941 | 0.946 | 1.826 | −0.599 | 0.946 |
| 1.778 | −0.022 | 0.919 | 0.791 | 1.230 | 0.946 | 1.664 | 0.214 | 0.946 |
| 1.728 | 0.091 | 0.919 | 0.485 | 0.891 | 0.946 | 1.788 | −0.551 | 0.946 |
| 1.703 | 0.148 | 0.919 | 0.693 | 0.763 | 0.946 | 1.762 | −0.010 | 0.946 |
| 1.600 | 0.372 | 0.919 | 1.175 | 0.211 | 0.946 | 1.880 | −0.292 | 0.946 |
| 1.724 | −0.473 | 0.919 | 0.969 | 1.192 | 0.946 | 1.738 | 0.047 | 0.946 |
| 1.802 | −0.079 | 0.919 | 0.866 | 0.590 | 0.946 | 1.639 | 0.270 | 0.946 |
| 1.879 | −0.665 | 0.919 | 0.945 | 0.497 | 0.946 | 1.689 | 0.159 | 0.946 |
| 1.763 | −0.521 | 0.919 | 1.137 | 0.259 | 0.946 | 1.750 | −0.503 | 0.946 |
| 1.850 | −0.192 | 0.919 | 1.213 | 0.163 | 0.946 | 1.864 | −0.647 | 0.946 |
| 1.955 | −0.763 | 0.919 | 1.168 | 1.052 | 0.946 | 1.712 | −0.456 | 0.946 |
| 2.134 | −1.014 | 0.919 | 1.023 | 1.164 | 0.946 | 1.810 | −0.122 | 0.946 |
| 1.992 | −0.812 | 0.919 | 1.099 | 0.307 | 0.946 | 1.714 | 0.103 | 0.946 |
| 2.038 | −0.648 | 0.919 | 1.060 | 0.355 | 0.946 | 1.613 | 0.326 | 0.946 |
| 2.180 | −1.075 | 0.919 | 0.911 | 1.213 | 0.946 | 1.673 | −0.408 | 0.946 |
| 1.968 | −0.477 | 0.919 | 1.251 | 0.116 | 0.946 | 1.834 | −0.179 | 0.946 |
| 2.099 | −0.963 | 0.919 | 1.210 | 1.008 | 0.946 | 1.857 | −0.235 | 0.946 |
| 2.180 | −0.990 | 0.919 | 1.075 | 1.131 | 0.946 | 2.047 | −0.892 | 0.946 |
| 1.991 | −0.534 | 0.919 | 0.824 | 0.636 | 0.946 | 2.188 | −1.041 | 0.946 |
| 1.917 | −0.714 | 0.919 | 1.022 | 0.402 | 0.946 | 1.974 | −0.518 | 0.946 |
| 1.897 | −0.306 | 0.919 | 1.289 | 0.068 | 0.946 | 1.902 | −0.695 | 0.946 |
| 2.064 | −0.912 | 0.919 | 1.249 | 0.961 | 0.946 | 2.044 | −0.687 | 0.946 |
| 2.206 | −1.062 | 0.919 | 0.906 | 0.544 | 0.946 | 1.939 | −0.744 | 0.946 |
| 2.062 | −0.705 | 0.919 | 0.984 | 0.450 | 0.946 | 1.904 | −0.348 | 0.946 |

TABLE I-continued

| X | Y | Z' | X | Y | Z' | X | Y | Z' |
|---|---|---|---|---|---|---|---|---|
| 2.156 | −0.934 | 0.919 | 1.286 | 0.912 | 0.946 | 1.927 | −0.405 | 0.946 |
| 2.116 | −0.993 | 0.946 | 1.202 | 1.013 | 0.973 | 1.910 | −0.389 | 0.973 |
| 2.082 | −0.942 | 0.946 | 0.905 | 0.557 | 0.973 | 2.131 | −1.023 | 0.973 |
| 1.997 | −0.574 | 0.946 | 1.118 | 1.100 | 0.973 | 1.887 | −0.677 | 0.973 |
| 2.114 | −0.857 | 0.946 | 1.208 | 0.178 | 0.973 | 1.980 | −0.557 | 0.973 |
| 2.011 | −0.842 | 0.946 | 0.854 | 1.241 | 0.973 | 1.887 | −0.333 | 0.973 |
| 2.091 | −0.800 | 0.946 | 1.161 | 1.058 | 0.973 | 2.171 | −1.019 | 0.973 |
| 1.975 | −0.793 | 0.946 | 1.058 | 0.368 | 0.973 | 2.120 | −0.893 | 0.973 |
| 2.178 | −1.052 | 0.946 | 0.912 | 1.225 | 0.973 | 2.098 | −0.972 | 0.973 |
| 2.021 | −0.631 | 0.946 | 1.377 | 0.766 | 0.973 | 2.003 | −0.613 | 0.973 |
| 1.950 | −0.461 | 0.946 | 1.548 | 0.445 | 0.973 | 2.144 | −0.948 | 0.973 |
| 2.068 | −0.744 | 0.946 | 1.466 | 0.607 | 0.973 | 2.050 | −0.725 | 0.973 |
| 2.187 | −1.025 | 0.946 | 1.408 | 0.714 | 0.973 | 2.073 | −0.781 | 0.973 |
| 2.149 | −1.044 | 0.946 | 1.397 | −0.059 | 0.973 | 1.959 | −0.774 | 0.973 |
| 2.138 | −0.913 | 0.946 | 1.494 | 0.554 | 0.973 | 2.096 | −0.837 | 0.973 |
| 2.162 | −1.054 | 0.946 | 1.511 | −0.201 | 0.973 | 2.160 | −1.031 | 0.973 |
| 2.162 | −0.969 | 0.946 | 1.522 | 0.499 | 0.973 | 1.923 | −0.725 | 0.973 |
| 0.498 | 0.913 | 0.973 | 1.312 | 0.868 | 0.973 | 2.144 | −1.033 | 0.973 |
| 0.742 | 0.736 | 0.973 | 1.435 | −0.107 | 0.973 | 2.026 | −0.669 | 0.973 |
| 0.674 | 1.227 | 0.973 | 1.359 | −0.012 | 0.973 | 2.169 | −1.003 | 0.973 |
| 0.465 | 1.020 | 0.973 | 1.345 | 0.817 | 0.973 | 2.030 | −0.872 | 0.973 |
| 0.550 | 0.882 | 0.973 | 1.586 | −0.296 | 0.973 | 1.956 | −0.501 | 0.973 |
| 0.733 | 1.242 | 0.973 | 1.473 | −0.154 | 0.973 | 1.995 | −0.823 | 0.973 |
| 0.491 | 1.075 | 0.973 | 1.321 | 0.036 | 0.973 | 0.561 | 0.903 | 1.000 |
| 0.793 | 1.247 | 0.973 | 1.548 | −0.249 | 0.973 | 0.612 | 0.870 | 1.000 |
| 0.527 | 1.123 | 0.973 | 1.574 | 0.390 | 0.973 | 0.786 | 0.705 | 1.000 |
| 0.602 | 0.852 | 0.973 | 1.437 | 0.661 | 0.973 | 0.677 | 1.247 | 1.000 |
| 0.652 | 0.816 | 0.973 | 1.700 | −0.438 | 0.973 | 0.473 | 1.039 | 1.000 |
| 0.571 | 1.166 | 0.973 | 1.662 | −0.391 | 0.973 | 0.736 | 1.261 | 1.000 |
| 0.785 | 0.693 | 0.973 | 1.794 | −0.109 | 0.973 | 0.498 | 1.094 | 1.000 |
| 0.620 | 1.201 | 0.973 | 1.723 | 0.058 | 0.973 | 0.575 | 1.186 | 1.000 |
| 0.698 | 0.777 | 0.973 | 1.850 | −0.629 | 0.973 | 0.745 | 0.749 | 1.000 |
| 0.462 | 0.961 | 0.973 | 1.650 | 0.225 | 0.973 | 0.510 | 0.935 | 1.000 |
| 1.133 | 0.273 | 0.973 | 1.818 | −0.165 | 0.973 | 0.533 | 1.143 | 1.000 |
| 0.982 | 0.463 | 0.973 | 1.625 | 0.280 | 0.973 | 0.623 | 1.221 | 1.000 |
| 0.968 | 1.202 | 0.973 | 1.775 | −0.533 | 0.973 | 0.796 | 1.263 | 1.000 |
| 1.278 | 0.918 | 0.973 | 1.747 | 0.003 | 0.973 | 0.472 | 0.980 | 1.000 |
| 1.171 | 0.226 | 0.973 | 1.600 | 0.335 | 0.973 | 0.658 | 0.832 | 1.000 |
| 1.020 | 0.416 | 0.973 | 1.771 | −0.053 | 0.973 | 0.702 | 0.791 | 1.000 |
| 1.246 | 0.131 | 0.973 | 1.864 | −0.277 | 0.973 | 1.017 | 0.429 | 1.000 |
| 1.095 | 0.321 | 0.973 | 1.738 | −0.485 | 0.973 | 1.167 | 0.241 | 1.000 |
| 1.021 | 1.173 | 0.973 | 1.675 | 0.170 | 0.973 | 1.018 | 1.181 | 1.000 |
| 0.944 | 0.510 | 0.973 | 1.699 | 0.114 | 0.973 | 1.204 | 0.194 | 1.000 |
| 1.241 | 0.966 | 0.973 | 1.624 | −0.343 | 0.973 | 0.904 | 0.569 | 1.000 |
| 1.284 | 0.083 | 0.973 | 1.841 | −0.221 | 0.973 | 1.067 | 1.145 | 1.000 |
| 1.071 | 1.138 | 0.973 | 1.813 | −0.581 | 0.973 | 0.865 | 0.615 | 1.000 |
| 0.866 | 0.603 | 0.973 | 1.933 | −0.445 | 0.973 | 1.055 | 0.382 | 1.000 |
| 0.826 | 0.648 | 0.973 | 2.064 | −0.922 | 0.973 | 1.232 | 0.972 | 1.000 |
| 1.242 | 0.146 | 1.000 | 1.636 | 0.236 | 1.000 | | | |
| 0.967 | 1.212 | 1.000 | 1.689 | −0.419 | 1.000 | | | |
| 0.855 | 1.255 | 1.000 | 1.726 | −0.467 | 1.000 | | | |
| 1.092 | 0.335 | 1.000 | 1.848 | −0.262 | 1.000 | | | |
| 1.279 | 0.099 | 1.000 | 1.612 | 0.291 | 1.000 | | | |
| 0.913 | 1.238 | 1.000 | 1.802 | −0.151 | 1.000 | | | |
| 1.194 | 1.018 | 1.000 | 1.939 | −0.484 | 1.000 | | | |
| 1.268 | 0.923 | 1.000 | 1.962 | −0.540 | 1.000 | | | |
| 1.154 | 1.063 | 1.000 | 1.943 | −0.754 | 1.000 | | | |
| 1.130 | 0.288 | 1.000 | 2.081 | −0.951 | 1.000 | | | |
| 1.302 | 0.874 | 1.000 | 2.114 | −1.002 | 1.000 | | | |
| 0.826 | 0.660 | 1.000 | 2.032 | −0.706 | 1.000 | | | |
| 1.112 | 1.106 | 1.000 | 2.055 | −0.761 | 1.000 | | | |
| 0.942 | 0.522 | 1.000 | 2.126 | −1.011 | 1.000 | | | |
| 0.980 | 0.476 | 1.000 | 2.102 | −0.872 | 1.000 | | | |
| 1.391 | −0.042 | 1.000 | 2.142 | −1.009 | 1.000 | | | |
| 1.577 | −0.278 | 1.000 | 1.978 | −0.803 | 1.000 | | | |
| 1.587 | 0.345 | 1.000 | 2.126 | −0.927 | 1.000 | | | |
| 1.428 | −0.089 | 1.000 | 1.916 | −0.429 | 1.000 | | | |
| 1.482 | 0.562 | 1.000 | 2.153 | −0.997 | 1.000 | | | |
| 1.426 | 0.668 | 1.000 | 2.152 | −0.982 | 1.000 | | | |
| 1.562 | 0.400 | 1.000 | 2.008 | −0.651 | 1.000 | | | |
| 1.509 | 0.508 | 1.000 | 2.013 | −0.852 | 1.000 | | | |
| 1.366 | 0.772 | 1.000 | 1.893 | −0.373 | 1.000 | | | |
| 1.465 | −0.136 | 1.000 | 1.908 | −0.706 | 1.000 | | | |
| 1.536 | 0.454 | 1.000 | 2.047 | −0.902 | 1.000 | | | |
| 1.455 | 0.615 | 1.000 | 1.985 | −0.595 | 1.000 | | | |
| 1.335 | 0.824 | 1.000 | 2.078 | −0.817 | 1.000 | | | |
| 1.316 | 0.052 | 1.000 | | | | | | |

TABLE I-continued

| X | Y | Z' | X | Y | Z' | X | Y | Z' |
|---|---|---|---|---|---|---|---|---|
| 1.353 | 0.005 | 1.000 | | | | | | |
| 1.503 | −0.183 | 1.000 | | | | | | |
| 1.540 | −0.231 | 1.000 | | | | | | |
| 1.397 | 0.721 | 1.000 | | | | | | |
| 1.825 | −0.206 | 1.000 | | | | | | |
| 1.763 | −0.514 | 1.000 | | | | | | |
| 1.685 | 0.126 | 1.000 | | | | | | |
| 1.870 | −0.318 | 1.000 | | | | | | |
| 1.779 | −0.095 | 1.000 | | | | | | |
| 1.614 | −0.325 | 1.000 | | | | | | |
| 1.799 | −0.562 | 1.000 | | | | | | |
| 1.732 | 0.015 | 1.000 | | | | | | |
| 1.661 | 0.181 | 1.000 | | | | | | |
| 1.652 | −0.372 | 1.000 | | | | | | |
| 1.755 | −0.040 | 1.000 | | | | | | |
| 1.836 | −0.610 | 1.000 | | | | | | |
| 1.872 | −0.658 | 1.000 | | | | | | |
| 1.709 | 0.071 | 1.000 | | | | | | |

Figure 4:
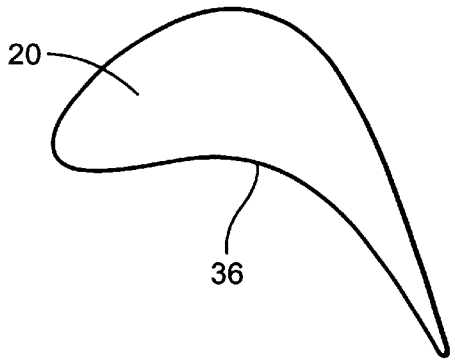
FIG. 4 is an outline of the root section of the airfoil.
Figure 5:
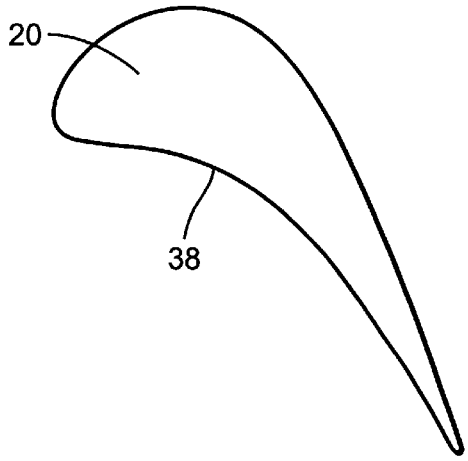
FIG. 5 is an outline of a pitch section of the airfoil.
Figure 6:
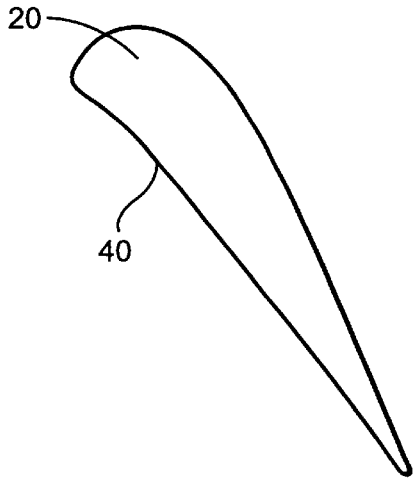
FIG. 6 is an outline of the tip section of the airfoil.

The airfoil profiles 36, 38 and 40 at the root 31 of the airfoil, a location intermediate the root 31 and tip 33 are schematically illustrated in FIGS. 4, 5 and 6, respectively.

It will also be appreciated that the airfoil disclosed in the above Table may be scaled up or down geometrically for use in other similar turbine designs. Consequently, the coordinate values set forth in Table 1 may be scaled upwardly or downwardly such that the airfoil section shape remains unchanged. A scaled version of the coordinates in Table 1 would be represented by X, Y and Z coordinate values of Table 1, with the non-dimensional Z coordinate value converted to inches, multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape.

2. A turbine bucket according to claim 1 forming part of a second stage of a turbine.

3. A turbine bucket according to claim 1 wherein said airfoil shape lies in an envelope within ±0.160 inches in a direction normal to any airfoil surface location.

4. A turbine bucket including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

5. A turbine bucket according to claim 4 forming part of a second stage of a turbine.

6. A turbine bucket according to claim 4 wherein said airfoil shape lies in an envelope within ±0.160 inches in a direction normal to any airfoil surface location.

7. A turbine comprising a turbine wheel having a plurality of buckets, each of said buckets including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define the airfoil profile sections at each distance Z, the profile sections at the Z distances being joined smoothly with one another to form a complete airfoil shape.

8. A turbine according to claim 7 wherein the turbine wheel comprises a second stage of the turbine.

9. A turbine according to claim 7 wherein the turbine wheel has 60 buckets and X represents a distance parallel to the turbine axis of rotation.

10. A turbine comprising a turbine wheel having a plurality of buckets, each of said buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a wheel scaled-up or scaled-down bucket airfoil.

11. A turbine according to claim 10 wherein the turbine wheel comprises a second stage of the turbine.

12. A turbine according to claim 10 wherein the turbine has 60 buckets and X represents a distance parallel to the turbine axis of rotation.

* * * * *